US007222511B2

(12) United States Patent
Durney et al.

(10) Patent No.: US 7,222,511 B2
(45) Date of Patent: May 29, 2007

(54) PROCESS OF FORMING BEND-CONTROLLING STRUCTURES IN A SHEET OF MATERIAL, THE RESULTING SHEET AND DIE SETS THEREFOR

(75) Inventors: Max W. Durney, San Francisco, CA (US); Philip M. Arnold, Redwood City, CA (US)

(73) Assignee: Industrial Origami, Inc., San Francisco, CA (US)

( * ) Notice: Subject to any disclaimer, the term of this patent is extended or adjusted under 35 U.S.C. 154(b) by 101 days.

(21) Appl. No.: 10/985,373

(22) Filed: Nov. 9, 2004

(65) Prior Publication Data

US 2005/0061049 A1 Mar. 24, 2005

Related U.S. Application Data

(63) Continuation-in-part of application No. 10/795,077, filed on Mar. 3, 2004, now Pat. No. 7,152,450, which is a continuation-in-part of application No. 10/256,870, filed on Sep. 26, 2002, now Pat. No. 6,877,349, which is a continuation-in-part of application No. 09/640,267, filed on Aug. 17, 2000, now Pat. No. 6,481,259.

(51) Int. Cl.
*B21D 5/00* (2006.01)
*B21D 28/10* (2006.01)

(52) U.S. Cl. ..... 72/324; 72/379.2; 83/46; 83/636

(58) Field of Classification Search ..... 72/324, 72/325, 379.2, 334; 83/46, 56, 636
See application file for complete search history.

(56) References Cited

U.S. PATENT DOCUMENTS 975,121 A 11/1910 Carter (Continued)

FOREIGN PATENT DOCUMENTS

DE 298 18 909 U1 2/1999

(Continued)

OTHER PUBLICATIONS

Patent Abstracts of Japan, vol. 004, No. 053 (M-008), Apr. 19, 1980 (JP 55-022468 A).

(Continued)

*Primary Examiner*—Daniel C. Crane
(74) *Attorney, Agent, or Firm*—Morgan, Lewis & Bockius LLP; David J. Brezner; Victor E. Johnson

(57) ABSTRACT

A process of forming bend-controlling structures, such as slits, grooves or displacements (22), in a sheet of material (21, 121, 221, 321, 421, 521, 621, 721). The bend-controlling structures (22) have central portions (26) extending substantially parallel to a desired bend line (23) on the sheet and end portions (27) which diverge away from the bend line (23). In one embodiment the process includes the step of forming the bending straps (24) between pairs of slit end portions (27) at a desired spaced apart distances along the bend line (23) with the straps (24) having a desired configuration, and the step of forming central portions (26) which connect the end portions (27) to complete the slits (22) using a separate die set. A plurality of end portion dies (51/54) can be used to produce end portions (27) of various shapes and straps (24) of various widths, and a single set of central portion forming dies (71/74) are used to connect the end portions (27). In other embodiments die sets producing a single end portion (27) or mirror image impressions (A,B) are used and preferably overlapped to produce the complete bend-controlling structure (22). A modular die assembly (500) also is disclosed in which the bend-controlling structures can be produced by modular die inserts (511-514, 611-614). Finally, a selection of die sets (722*a*, 722*b*, 722*c*) of differing length from a group of die sets can be made to position the bending straps (24) at desired locations along the bend line.

37 Claims, 12 Drawing Sheets

U.S. PATENT DOCUMENTS

| | | | | |
|---|---|---|---|---|
| 1,295,769 | A | | 2/1919 | Kux |
| 1,405,042 | A | | 1/1922 | Kraft |
| 1,698,891 | A | | 1/1929 | Overbury |
| 2,127,618 | A | | 8/1938 | Riemenschneider |
| 2,560,786 | A | | 7/1951 | Wright et al. |
| 3,228,710 | A | * | 1/1966 | Chodorowski ..... 281/38 |
| 3,258,380 | A | | 6/1966 | Fischer et al. |
| 3,341,395 | A | | 9/1967 | Weber |
| 3,353,639 | A | | 11/1967 | Andriussi |
| 3,756,499 | A | | 9/1973 | Giebel et al. |
| 3,788,934 | A | | 1/1974 | Coppa |
| 3,854,859 | A | | 12/1974 | Sola |
| 3,938,657 | A | | 2/1976 | David |
| 3,963,170 | A | | 6/1976 | Wood |
| 4,215,194 | A | | 7/1980 | Sheperd |
| 4,289,290 | A | | 9/1981 | Miller |
| 4,559,259 | A | | 12/1985 | Cetrelli |
| 4,628,661 | A | | 12/1986 | St. Louis |
| 4,837,066 | A | | 6/1989 | Quinn et al. |
| 4,951,967 | A | * | 8/1990 | Michalik ..... 281/2 |
| 5,148,900 | A | | 9/1992 | Mohan |
| 5,157,852 | A | | 10/1992 | Patrou et al. |
| 5,225,799 | A | | 7/1993 | West et al. |
| 5,239,741 | A | | 8/1993 | Shamos |
| 5,333,519 | A | * | 8/1994 | Holliday et al. ..... 76/107.8 |
| 5,390,782 | A | | 2/1995 | Sinn |
| 5,524,396 | A | | 6/1996 | Lalvani |
| 5,568,680 | A | | 10/1996 | Parker |
| 5,692,672 | A | | 12/1997 | Hunt |
| 5,701,780 | A | | 12/1997 | Ver Meer |
| 5,709,913 | A | | 1/1998 | Anderson et al. |
| 5,789,050 | A | | 8/1998 | Kang |
| 5,885,676 | A | | 3/1999 | Lobo et al. |
| 6,132,349 | A | | 10/2000 | Yokoyama |
| 6,210,037 | B1 | | 4/2001 | Brandon, Jr. |
| 6,412,325 | B1 | | 7/2002 | Croswell |
| 6,481,259 | B1 | | 11/2002 | Durney |
| 6,599,601 | B2 | | 7/2003 | Fogle et al. |
| 6,640,605 | B2 | | 11/2003 | Gitlin et al. |
| 6,643,561 | B1 | | 11/2003 | Torvinen |
| 6,658,316 | B1 | | 12/2003 | Mehta et al. |
| 6,877,349 | B2 | | 4/2005 | Durney et al. |
| 2001/0010167 | A1 | | 8/2001 | Leek |
| 2002/0184936 | A1 | | 12/2002 | Gitlin et al. |
| 2003/0037586 | A1 | | 2/2003 | Durney et al. |
| 2004/0035175 | A1 | | 2/2004 | Karhumaki |
| 2004/0134250 | A1 | | 7/2004 | Durney et al. |
| 2004/0206152 | A1 | | 10/2004 | Durney et al. |
| 2005/0005670 | A1 | | 1/2005 | Durney et al. |
| 2005/0061049 | A1 | | 3/2005 | Durney et al. |
| 2005/0064138 | A1 | | 3/2005 | Durney et al. |
| 2005/0097937 | A1 | | 5/2005 | Durney et al. |
| 2005/0126110 | A1 | | 6/2005 | Durney et al. |

FOREIGN PATENT DOCUMENTS

| | | |
|---|---|---|
| GB | 2 129 339 A | 5/1984 |
| JP | 52-068848 | 6/1977 |
| JP | 53-070069 | 6/1978 |
| JP | 55-022468 | 2/1980 |
| JP | 55-055222 | 4/1980 |
| JP | 59-006116 | 1/1984 |
| JP | 02-065416 U | 5/1990 |
| JP | 02-165817 | 6/1990 |
| JP | 02-192821 | 7/1990 |
| JP | 02-258116 | 10/1990 |
| JP | 04-033723 | 2/1992 |
| JP | 04-091822 | 3/1992 |
| JP | 05-261442 | 10/1993 |
| JP | 07-148528 | 6/1995 |
| JP | 08-224619 | 9/1996 |
| JP | 10-085837 | 4/1998 |
| JP | 11-123458 | 5/1999 |
| JP | 11-188426 | 7/1999 |
| WO | WO 97/24221 A1 | 7/1997 |
| WO | WO 02/13991 A1 | 2/2002 |

OTHER PUBLICATIONS

Patent Abstracts of Japan, vol. 015, No. 006 (M-1066), Jan. 8, 1991 (JP 02-258116 A).

Publication "Office dA" by Contemporary World Architects, 2000, pp. 15, 20-35, Rockport Publishers, Inc., Gloucester, Massachusetts.

*EasyBend™—Complex Bending Made Easy*, © 2004 Mate Precision Tooling Inc., Anoka, Minnesota.

* cited by examiner

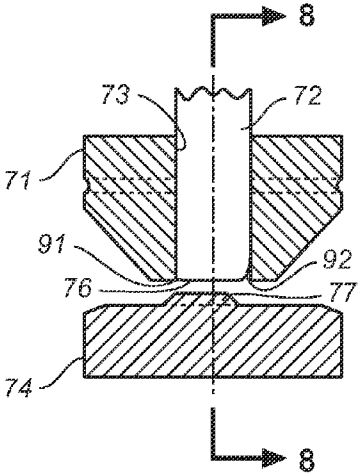
FIG. 7
FIG. 8
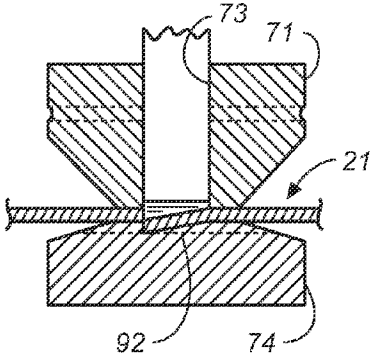
FIG. 9
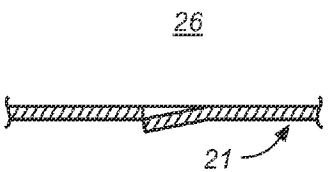
FIG. 10
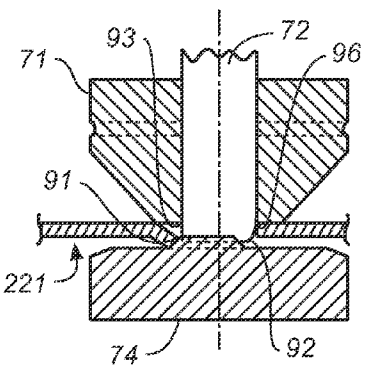
FIG. 11
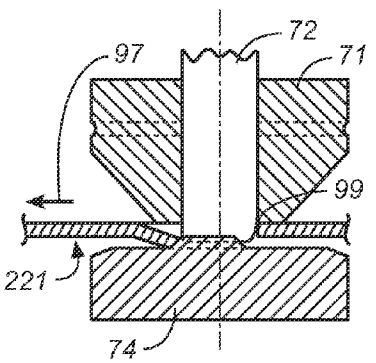
FIG. 12
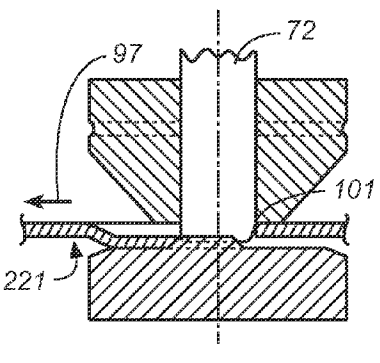
FIG. 13
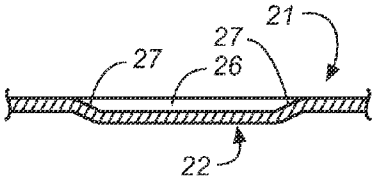
FIG. 14

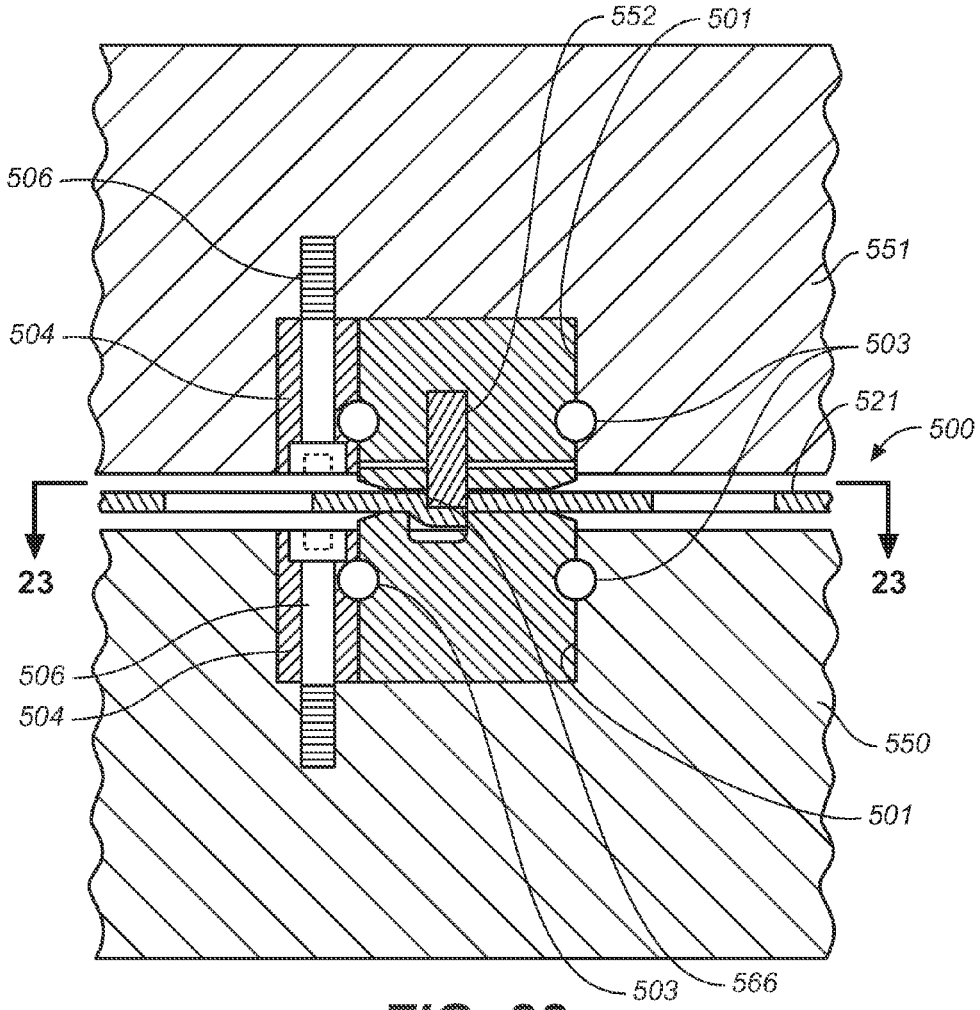
FIG. 22
FIG. 23
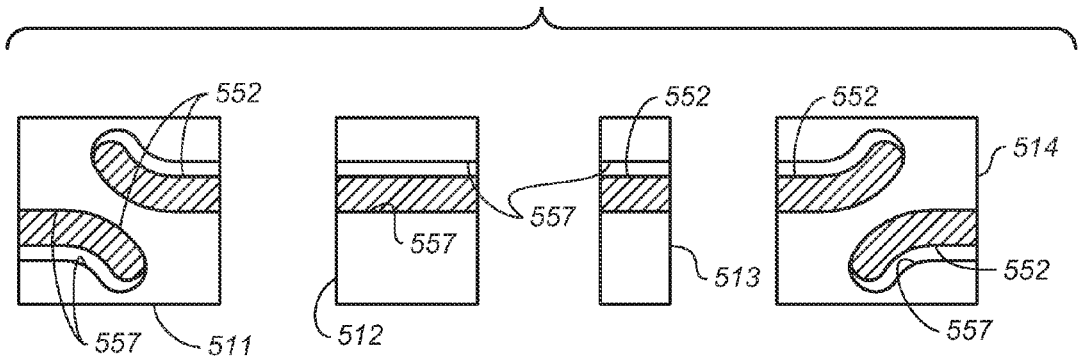

PROCESS OF FORMING BEND-CONTROLLING STRUCTURES IN A SHEET OF MATERIAL, THE RESULTING SHEET AND DIE SETS THEREFOR

RELATED APPLICATIONS

This application is a continuation-in-part application based upon a patent application Ser. No. 10/795,077, filed Mar. 3, 2004, now U.S. Pat. No. 7,152,450, and entitled Sheet Material with Bend Controlling Displacements and Method for Forming the Same, which is a continuation-in-part application based upon patent application Ser. No. 10/256,870, filed Sep. 26, 2002, now U.S. Pat. No. 6,877,349, and entitled Method for Precision Bending of Sheet Materials, Slit Sheet and Fabrication Process, which was a continuation-in-part application based upon a parent application Ser. No. 09/640,267, filed Aug. 17, 2000, and entitled Method for Precision Bending of a Sheet of Material and Slit Sheet Therefor, now U.S. Pat. No. 6,481,259 B1.

TECHNICAL FIELD

The present invention relates, in general, to methods of positioning and/or configuring bend-controlling structures, such as slits, grooves or displacements, in a sheet of material, and methods of using stamping or punching dies to form such structures, and more particularly, relates to stamping or punching processes which can be more economically employed for flexible or low volume manufacturing of folded or bent sheet-based products.

BACKGROUND ART

Flexible, rapid or low volume manufacturing is becoming more prevalent in many industries. A first low volume run of products will be produced and then marketed. Market feedback will be obtained, indicating that certain product modifications would be desirable, and the feedback used to modify the product for another low volume production run. This flexible or rapid manufacturing process allows manufacturers to cause their products to evolve to meet evolving user needs. Users, of course, find the responsiveness of manufacturers who have flexible manufacturing capabilities to be highly desirable.

In prototyping situations, even lower production runs can be made for the purpose of testing product designs before they are marketed. The final prototyped design can then be manufactured using flexible manufacturing low volume runs or high volume, hard tooling, production runs.

One of the important threshold design considerations, when making products from sheet material using bend-controlling slits, grooves or displacements, is the positioning and configuration of the bend-controlling structures and the positioning and configuration of the resulting bending straps between the bend-controlling structures. Thus, edge effects, stress concentrations, scrap reduction and interactions with sheet openings or structural features on the sheet all can be important design considerations that may require that changes be made to the bend-controlling slits, grooves or displacements and/or the bending straps.

The related applications set forth above disclose several techniques for manufacturing or forming bend-controlling structures that will precisely produce bending of the sheet material of these related applications, the application entitled Sheet Material with Bend Controlling Displacements and Method for Forming the Same, Ser. No. 10/795,077 is particularly pertinent in that it has an extensive disclosure as to stamping or punching processes which are particularly well suited for the economical formation of bend-controlling structures in sheet material. The bend-controlling structures of the related applications most desirably produce edge-to-face engagement of the sheet material on opposite sides of the slits for precise bending of the sheet. All of the above-identified related applications are incorporated herein by reference in their entireties.

As disclosed in the related application, bend-controlling slits, grooves or displacements can have various shapes and lengths. Moreover, the width and shape of the bending straps between longitudinally adjacent bend-controlling structures can have their configurations varied, depending upon the shape of the end portion of each bend-controlling slit, groove or displacement and the jog or transverse distance across the bend line between longitudinally adjacent slits, grooves or displacements.

As used herein, the expression "bend-controlling structures" shall mean the slits, grooves, displacements or other structures which define the bending straps extending across the desired bend line. It will be understood from the related applications, however, that the bending straps defined by the bend-controlling structures cooperate or combine with the slits, grooves or displacements to control sheet bending.

Significant economic benefits can be achieved by stamping or punching bend-controlling structures into the sheet material. The present invention seeks to reduce the stamping or punching costs further by providing die set alternatives which reduce costs and yet accommodate the various positioning and shape requirements for bend-controlling structures that will produce the desired product performance.

It is possible to employ a plurality of different stamping or punching die sets, with each die set having mating die surfaces that produce the entire bend-controlling structure. These die sets can be economically used for flexible manufacturing processes. As will be appreciated, however, an approach which is based upon a different die set for each possible slit configuration and/or bending strap width can result in an undesirably large number of punching or stamping dies sets. The present invention addresses this problem by providing several alternative solutions which reduce the cost of having a large inventory of die sets.

As part of any product design process, it is desirable for the length of the slits, grooves or displacements used to control sheet bending to be varied to accommodate the particular design. Product dimensions, for example, usually cannot be varied to accommodate slit dimensions, and particularly slit lengths. Thus, a product may have a wall which has to have a fixed width or length, and when designing the bend-controlling structures, the length of the slits, grooves or displacements producing bending of that wall is most preferably varied to accommodate the fixed wall length of the final structure. Moreover, when bend-controlling slits, grooves or displacements extend out to an edge of a sheet material, it is desirable that the bend-controlling structure does not warp, deform or cause stress concentrations at the sheet edge. For some structures this is not a difficult task, but it also is influenced by the fixed width or length of the product walls.

Possible undesirable edge effects are further complicated by the desire to minimize scrap and by the fact that the slitting, grooving and displacing techniques taught in the prior related applications are particularly well suited for relatively complex folding of sheets. Thus, sheets having a plurality of fold lines, some of which are intersecting, are common. It is not unusual, for example, for a wall of a product to end in an edge that is immediately adjacent to another wall which will be folded or bent in another direction. Accordingly, one does not want to have the bend-inducing structures for a fold line along one wall of the sheet extend over into material beyond the edge of the wall that will be folded into a different plane. Similarly, scrap is increased if slits, grooves or displacement extend outwardly of the edge of one product into an adjacent portion of the sheet which is to be used to form additional products.

Accordingly, it is an object of the present invention to provide a method of forming bend-controlling structures in a sheet of material, and the sheet of material resulting therefrom, which is particularly well suited for flexible or rapid manufacturing applications, and for prototyping, of the three-dimensional products which will result upon bending of the formed sheet of material.

Another object of the present invention is to provide a method for manufacturing products from sheet material which is well suited for use in economical stamping and punching processes employing a minimum number of indexing stations or progressive stages.

Another object of the present invention is to provide a method and set of stamping or punching dies for forming bend-controlling structures in a sheet of material which enables variation of the configuration, length and spacing of the bend-controlling structures and the intermediate bending straps using a minimum number of die sets.

Still a further object of the present invention is to provide a method for positioning bend-controlling structures in the sheet of material which will allow the slits, grooves or displacements to be positioned in the most advantageous locations relative to edges and other structural features of the end product.

Still a further object of the present invention is to provide a process and set of dies for forming bend-controlling structures in a sheet of material which minimize scrap and accommodate complex folding of the sheet into different planes.

The process for forming bend-controlling structures in a sheet of material, the resulting sheet and the die sets therefor of the present invention have other objects and features of advantage which will be set forth in more detail in, and will be more apparent from, the following Best Mode of Carrying Out the Invention, as exemplified by and illustrated in the accompanying drawing.

DISCLOSURE OF THE INVENTION

The process of the present invention is suitable for forming bend-controlling structures which are positioned along a desired bend line in longitudinally displaced relation along alternating sides of the bend line, with longitudinally adjacent bend-controlling structures defining bending straps extending obliquely across the bend line. Each of the bend-controlling structures have a central portion extending parallel or substantially parallel to the bend line and end portions diverging away from the bend line at opposite ends of the central portion.

In one aspect, the process is comprised, briefly, of the steps of forming the bending straps between the longitudinally adjacent bend-controlling structures at desired spaced apart distances along the bend line and with desired bending strap configurations by forming the end portions of the slits, grooves or displacements which define the bending straps, and thereafter forming the remainder of the bend-controlling structures, usually by connecting end portions of the bend-controlling structures using a the central portion forming die set. In one stamping or punching embodiment, a first pair of laterally spaced apart end portions are simultaneously formed in the sheet of material on opposite sides of the bend line using an end portion forming die set. The die set is then rotated by 90 degrees and repositioned relative to the sheet to establish the desired spacing between end portions. A second pair of laterally spaced apart end portions is then simultaneously formed, and the process repeated down the bend line. Once the bending straps between bend-controlling slits, grooves or displacements have been formed, the step of forming the central portion is accomplished by using a central portion forming die set, which die set forms a segment of the length of the central portion. The central portion forming die set is then incrementally linearly translated or walked, for example in a rapid stroke mode, along the bend line from one of the previously formed end portions to the next end portion, preferably by moving or translating the sheet material, to complete the central portion of the bend-controlling structure.

In another stamping or punching embodiment, an individual end portion die set is used to form one end portion and then rotated and translated to form the opposite end portion. A central portion die set is incrementally translated or walked from one end portion to the other end portion to complete the bend-controlling structure. Additional bend-controlling structures are formed on both sides of the bend line in the same manner.

In still another stamping or punching embodiment, a left-hand and a right-hand die set are used with each die set including an end portion and a connected segment of the central portion of the bend-controlling structure. Bending strap widths are varied by inverting one of the die sets and selecting the longitudinal spacing as well as the jog distance between die sets. The length of the bend-controlling structure is controlled by selecting the overlap between central portion segments of the left-hand and the right-hand die sets.

The present process also includes a method for positioning bend-controlling structures relative to edges of the sheet of material and relative to weakened structural features, such as openings in the sheet of material. Such positioning can be achieved economically by using the stamping die sets for the end portions which define the bending straps first, and then, connecting the end portions with central portions.

In the broadest aspect, however, the bend-controlling structure positioning process also has application to bend-controlling structures which are formed by laser cutting, water jet cutting and other forming or material removal techniques.

When used for flexible or rapid relatively low volume manufacturing, or for prototyping, the present process includes the steps of varying one of the configuration and distance between the bending straps to produce the desired product. When prototyping, a plurality of varied prototype designs are created and bent structures for the varied prototype designs from the prototype runs are formed. A prototype bending strap configuration and spacing based upon testing of the bent structures is then selected, and high volume production dies are fabricated or low volume flexible manufacturing dies made based upon the selected design.

In another aspect of the present invention, stamping or punching die sets for accomplishing flexible manufacturing of bent structure are provided which include, briefly, at least one end portion forming die set formed to produce an end portion of a bend-controlling slit or groove, and a central portion die set formed to produce a segment of a connecting central portion of the slit, groove or displacement.

In still a further aspect, modular die set inserts are created that can be mounted into a die body to join various end portion insert modules with various central portion insert modules so that the bend-controlling structure is built up along the die body to produce the desired bend-controlling structure configurations and positionings.

Finally, substantial economic advantages also can be achieved by using a relatively small number of die sets formed to produce complete bend-controlling structures of varying length. A selection is then made from such die sets to produce a combination of bend-controlling structures of desired lengths, which are spaced along the bend line so that the number and width of the bending straps produces the desired bend strength, fatigue resistance and product performance characteristics.

DESCRIPTION OF THE DRAWING

FIG. 7 is a side elevation view, in cross section, of the central portion forming die set used to form the central portions shown in FIGS. 2 and 2B.

FIG. 8 is a side elevation view, in cross section, of the central portion forming die set, taken substantially along the plane of line 8-8 in FIG. 7.

FIG. 9 is a side elevation view, in cross section, corresponding to FIG. 8 and showing the die set punching the central portion segment in a sheet of material.

FIG. 10 is an end elevation view, in cross section, of the sheet of material after the central portion segment is formed.

FIG. 11 is a side elevation view, in cross section, of the central portion forming die set of FIG. 7 with a sheet of material being punched or stamped at one end of the central portion of a bend-controlling structure.

FIG. 12 is a side elevation view, in cross section, corresponding to FIG. 11, in which one of the die set and the sheet of material have been moved so as to position the central portion die set to the right of the position in FIG. 11 structure.

FIG. 13 is a further side elevation view of the die set of FIG. 11 in a further moved position to the right along the central portion of the bend-controlling structure.

FIG. 14 is a fragmentary, side elevation view, in cross section, of the sheet of material with a completed bend-inducing structure formed therein.

FIG. 22 is an end elevation view of a modular die set assembly constructed in accordance with the present invention.

FIG. 23 is a top plan view of modular dies usable in the die set assembly of FIG. 22 prior to mounting the dies in the die set assembly.

BEST MODE OF CARRYING OUT THE INVENTION

Reference will now be made in detail to the preferred embodiment of the present invention, examples of which are illustrated in the accompanying drawings. While the invention will be described in connection with the preferred embodiments, it will be understood that the illustrated embodiments are not intended to limit the invention. On the contrary, the invention is intended to cover alternatives, modifications and equivalents, which may be included within the spirit and scope of the invention, as defined by the appended claims.

Figure 1:
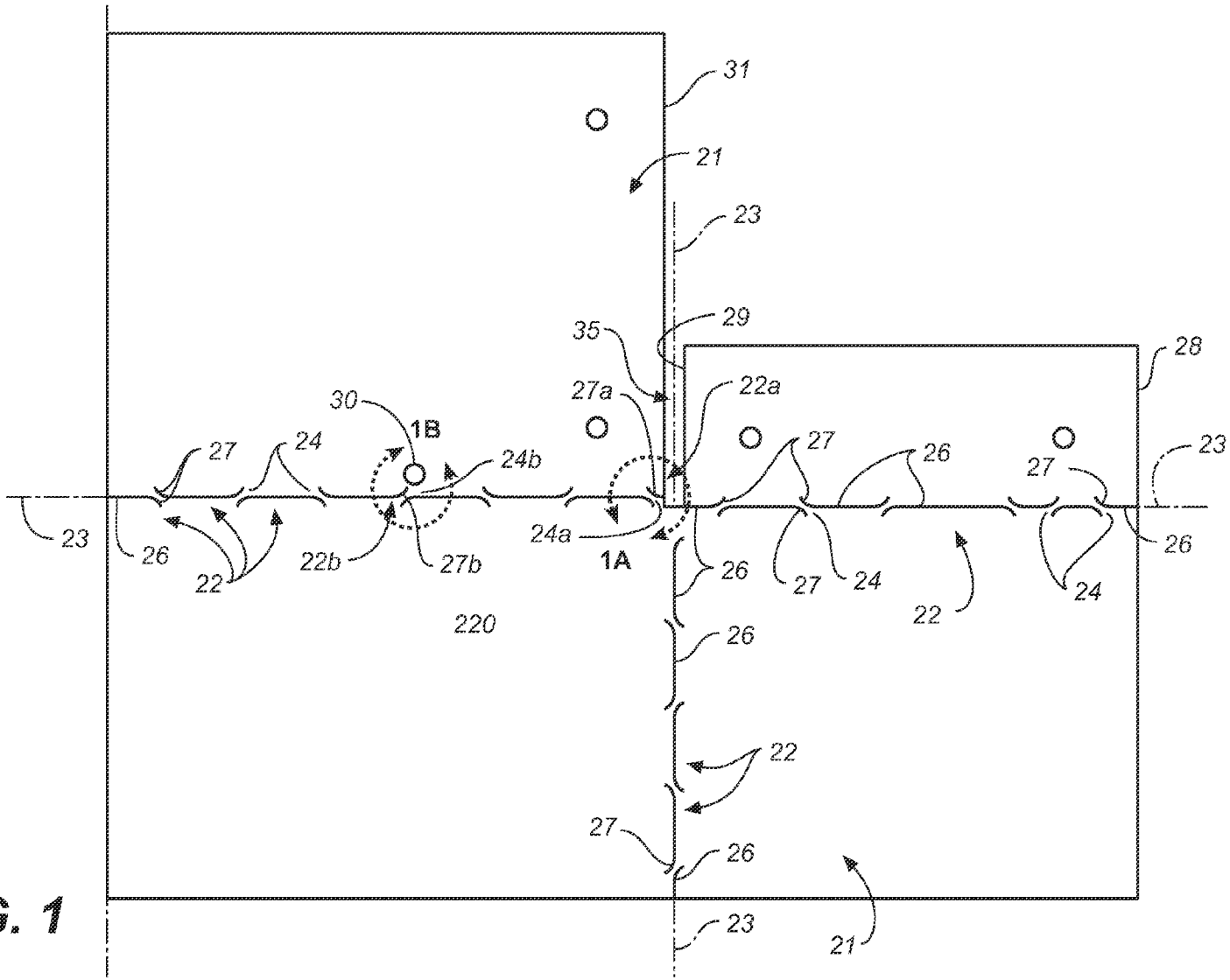
FIG. 1 is a top plan view of a sheet of material having bend-controlling structures positioned on it in accordance with the present invention and illustrating location of such structures relative to sheet edges and weakened structural features.

Referring now to FIG. 1, a sheet of material 21 is shown which has a plurality of bend-controlling structures, generally designated 22, formed therein along desired bend lines 23. In this case each bend-controlling structure 22 is shown as a slit which penetrates completely through the thickness dimension of sheet 21. As disclosed in the prior-related applications, grooves and displacements which do not penetrate completely through the thickness dimension of the sheet of material also can be used to control the bending of sheet material.

As will be seen, the slits or bend-controlling structures 22 extend along alternating sides of bend lines 23, and the ends of longitudinally adjacent slits 22 define bending straps 24 therebetween. Each bend-controlling structure 22 includes a central portion 26, which extends substantially parallel to bend lines 23, and end portions 27, which diverge away from bend lines 23 to define bending straps 24. In the form of bend-controlling structures shown in FIG. 1, end portions 27 are provided as arcuate end portions which curve away from bend lines 23. Bending straps 24, therefore, have a center line, for example, center line 25 in FIG. 1B, that extends obliquely across bend line 23. Bending strap center lines 25 are skewed in alternating directions. This construction, and still additional alternative end portion and slit configurations, are set forth in more detail in the above-referred to related applications, as is the edge-to-face engagement which can be achieved by these bend-controlling structures, which will result in precise control of bending of sheet 21 along bend lines 23. Such detail will not be repeated herein but is incorporated herein by reference from the related applications.

In related application Ser. No. 10/795,077 a process for forming slits along bend line is disclosed which is based upon using stamping or punching die sets. Stamping or punching of sheet material is often a highly economical way of fabricating products that can be formed by bending of the sheet material. In such a stamping or punching processes, it is quite feasible to have a die set which will produce each of the slits in a single stroke. However, if the configuration of the bend-controlling structures and the bending straps needs to be varied in order to allow sheets to be bent into the desired products in order to achieve various performance criteria (such as strength, accuracy and fatigue resistance), having a die set for each possible variation of the bend-controlling structures and the bending straps requires an undesirably large inventory of die sets.

The proper positioning of bend-controlling slits, grooves or displacements 22, and bending straps 24 therebetween along bend lines 23 will be critical to avoiding stress concentrations, edge warping effects and weaknesses in the bends at the edges or adjacent to openings in the sheets. Additionally, proper positioning of bend-controlling structures allows sheet scrap to be minimized.

It is an important aspect of the present invention, therefore, to provide a process for positioning the bend-controlling structures and bending straps such that complex bent products can be more economically formed and adverse edge effects and stress concentrations can be minimized.

Figure 1B:
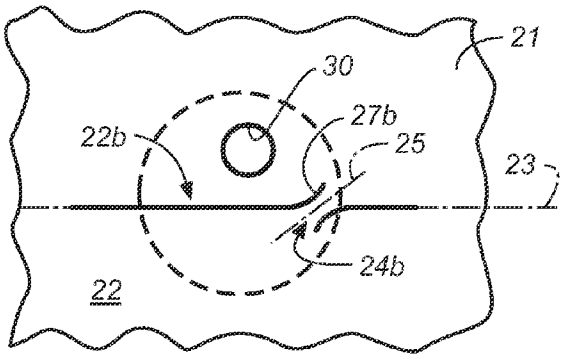
FIG. 1B is a fragmentary, enlarged, top plan view of the area bounded by broken line 1B-1B in FIG. 1.
Figure 1A:
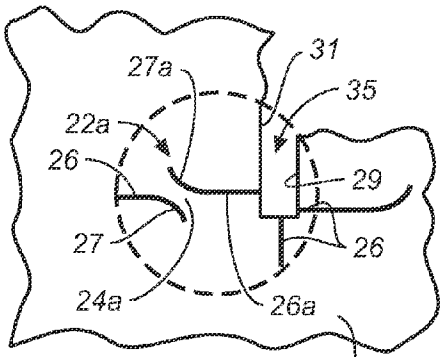
FIG. 1A is a fragmentary, enlarged, top plan view of the area bounded by broken line 1A-1A in FIG. 1.

FIG. 1 illustrates poor positioning of the bend-controlling structures, while FIGS. 1A and 1B illustrate improved positioning which can be implemented using the stamping and punching processes of the present invention. As a general rule, it is not desirable to have a curved or diverging end portion 27 of a bend-controlling structure 22 extend to a sheet edge, such as sheet edges 28, 29 or 31. As will be seen in FIG. 1, therefore, slits 22 which are positioned at sheet edges 28 and 29 both have central portions 26 which extend to the sheet edges. Since central portions 26 are usually parallel or substantially parallel to bend lines 23, central portions 26 of bend-controlling slits 22 exit the sheets in substantially the same angular relationship to edges 28 and 29 as bend line 23. This reduces any tendency of the bend-controlling structures to produce localized warping at the edges when the sheet is bent.

At edge 31 of sheet 21 in FIG. 1, however, a slit terminates at the tangent point of end portion 27*a* and what would be the start of central portion 26 of the same slit. This positions the slit end portion 27*a* too close to edge 31, and such positioning should be avoided. Bending strap 24*a* is too close to edge 31 and can cause warping or stress concentrations at edge 31.

FIG. 1A illustrates how the undesirable edge condition in FIG. 1 can be corrected. End portion 27*a* of slit 22*a* has been moved away from edge 31 sufficiently to be ideally centered so as to prevent localized distortion of the sheet at the edge in a direction transverse to the bend line. In FIG. 1A, the central portion 26*a* spaces end portion 27*a* away from edge 31 so that the stresses in bending strap 24*a* are directed into the body of sheet 21, not against edge 31 or the bottom of slot 35.

The distance at which the bending strap 24*a* should be spaced from sheet edge 31 to avoid stress concentrations will depend upon factors such as the material properties, the sheet thickness and loading of the bent product made from the sheet. The ability of the present invention to economically make low volume manufacturing runs allows factors, such as the end portion position and the bending strap position relative to sheet edges, to be tested by loading the resulting bent product. The position of the slit can be changed if such testing shows that such a change is necessary.

A similar stress concentration problem can occur when the sheet includes weakened structural features, such as an opening 30, which are proximate the bend lines. In FIG. 1, slit 22*b* has an end portion 27*b* which extends almost to opening 30. Thus, any crack propagation from slit end portion 27*b* will be directed at opening or weakened structural feature 30, which is generally undesirable. Additionally, bending strap 24 is positioned to direct stresses toward opening 30.

In FIG. 1B, the undesirable positioning of end 27*b* of bend-controlling structure 22*b* has been corrected. Thus, slit 22*b* has been moved along bend line 23 to the right of its position in FIG. 1 so that it is more ideally centered and neither end portion 27*b* nor strap 24*b* will direct stresses toward opening 30.

An additional bend-controlling structure positioning principal can be seen by considering the length of slits 22 between edges 28 and 29 of sheet 21 in FIG. 1. Slits 22 which are proximate edge 28 are relatively short. This results in more bending straps per unit length of the bend line proximate edge 28 than occurs per unit length along the rest of the bend line between edges 28 and 29. Such a construction concentrates bending straps 24 proximate sheet edge 28, where there may be a greater tendency to have the sheet tear along the bend line, starting at edge 28.

Resistance to bend line tearing also can be achieved proximate the sheet edges by increasing the transverse width of bending straps 24, either by increasing the jog distance (lateral spacing across the bend line of two bend-controlling structures) or by shifting the longitudinal spacing along the bend line, or both. Both approaches result in a greater strap width dimension (distance perpendicular to center line 25) and more strap cross sectional area (width times the sheet thickness) proximate the sheet edge. The increased cross sectional area of the bending straps near the edges also resists any tendency to propagate a tear down the bend line from the edge.

Another edge effect issue can be illustrated by FIG. 1A. Sheet 21 has been slit up to edge 31, which is closely juxtaposed to edge 29 when the sheet is in the flat or pre-bent condition. Adjacent edges 29 and 31 of the sheet are formed by a transverse slot 35 which extends part of the way down the sheet. In some cases the width dimension or kerf of slot 35 can be relatively small. It is highly desirable that slit 22*a* does not extend beyond edge 31 to an extent that it crosses slot 35 and extends into the adjacent sheet area on the other side of edge 29. Since bend line 23 along which slit 22*a* is positioned can be seen to be slightly above the bend line along which slits 22 that extend to edge 29 are positioned, a slit 22*a* which crossed over edge 29 would result in structural weakness and undesirable cosmetic effects on either side of slot 35.

The same undesirable effects or adjacent sheet areas will occur if a plurality of side-by-side parts are being formed from the same sheet of material, unless the parts are spaced apart from each other by an amount accommodating slit overlap. Such an accommodation, however, results in an undesirable increase in sheet scrap.

As will be appreciated, therefore, there are numerous factors that can make it highly desirable or necessary to vary the length, spacing and positioning of bend-controlling slits, grooves or displacements and the bending straps therebetween along a bend line. Moreover, it is often the case that the distance between sheet edges, such as edges 28 and 29, cannot be changed because of product requirements that cannot be changed. This results in a need to be able to change the length and positioning of the bend-controlling structures to accommodate the unchangeable product dimensions. Similarly, openings, slits and other weakened structural areas proximate the bend lines may also be unchangeable. The flexible or rapid manufacturing processes, and particularly stamping or punching processes, described below are particularly well suited for economically providing the necessary adjustments to the bend-controlling structures and the bending straps in order to produce the desired product.

Figure 2:
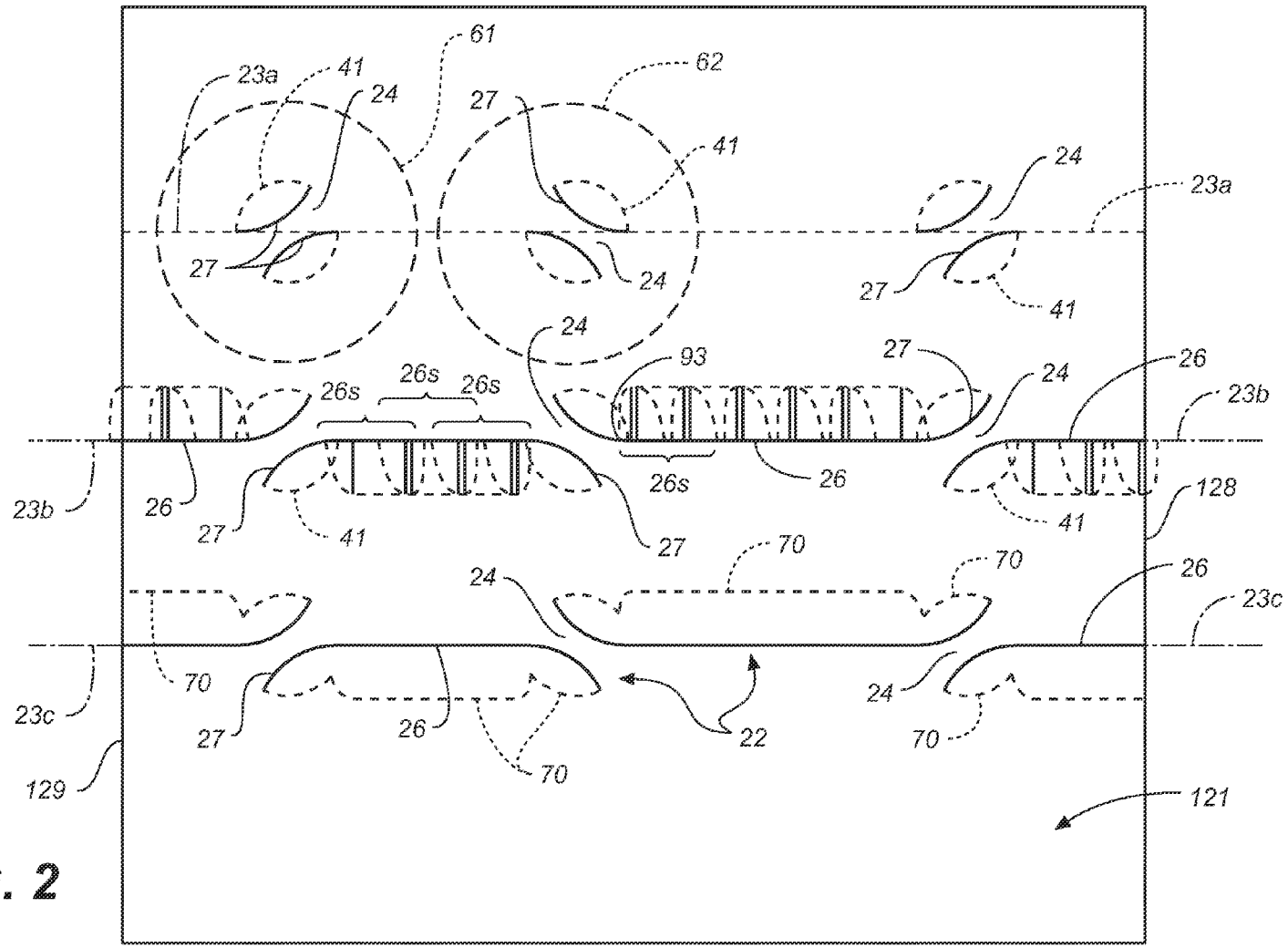
FIG. 2 is top plan view of another sheet of material showing the steps of forming a plurality of bend-controlling structures therein along desired bend lines in accordance with one embodiment of the process of the present invention.

Referring now to FIG. 2, an economical stamping or punching process for producing bend-controlling structures 22 of the present invention, which process facilitates design changes and can be employed in flexible manufacturing situations, can be described. In the present process formation of bending straps 24 using one punching or stamping die set to form the end portions 27 of the bend-controlling structures, and a second die set to complete the bend-controlling structure. The process, therefore, allows the building of bend-controlling slits, grooves or displacements by selecting a configuration of an end portion die set, or module, which defines bending straps 24, selecting a spacing of the bending straps along bend line 23, and then connecting the spaced bending straps by forming central portions 26 of the bend-controlling structures using a separate die set, or die module, and one, or more, punching or stamping strokes.

In FIG. 2, three desired bend lines 22*a*, 22*b* and 22*c* are shown on sheet 121. These bend lines illustrate two stages of the present process, and, on bend line 23*c*, the resulting completed bend-controlling structures and bending straps. Along bend line 23*a*, a plurality of opposed end portions 27 have been stamped or punched into sheet 121 to define bending straps 24 between each set of end portions 27. End portions 27 can be considered as having been stamped or punched downwardly into the page by a stamping or punching die set, as set forth in more detail below. The periphery at which each end portion is tilted downwardly out of the page is a slight bend which is shown schematically in FIGS. 2 and 2A by dotted lines 41 extending between the ends of an approximate quarter circle end portion 27. It will be understood, however, that end portion 27 could be tilted upwardly from the page or punched either up or down and then pressed or flattened back to be in the same plane as sheet 121. The longitudinal spacing along bend line 23*a* has been selected so that the resulting slits 22 will have central portions 26 (as shown along bend line 23*b*) that will extend to edges 128 and 129 of sheet 121, for the reasons set forth above.

Figure 3:
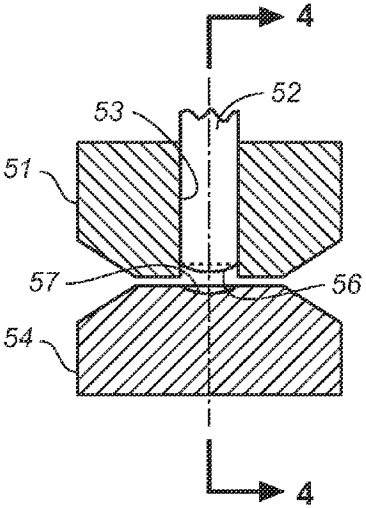
FIG. 3 is a side elevation view, in cross section, of a turret punch die set used to form the end portions shown in FIGS. 2 and 2A.
Figure 4:
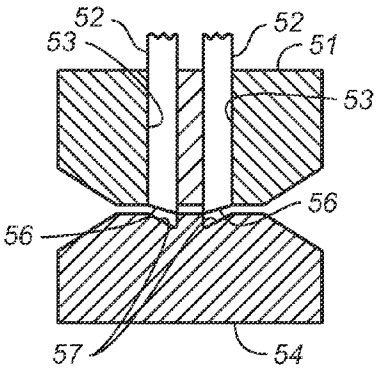
FIG. 4 is a side elevation view, in cross section, of the die set of FIG. 3 taken substantially along the plane of line 4-4 in FIG. 3.
Figure 5:
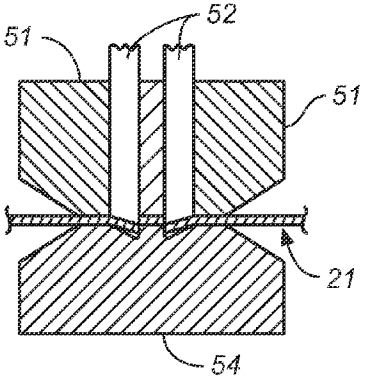
FIG. 5 is a side elevation view corresponding to FIG. 4 and showing the die set punching the end portions in a sheet of material.
Figure 6:
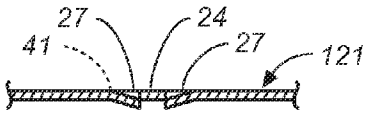
FIG. 6 is a fragmentary, side elevation view, in cross section, of the sheet of material having the end portions punched therein.

FIGS. 3, 4 and 5 show an embodiment of an end portion forming a turret punch die set used to create the pairs of end portions 27 by one punching stroke. Thus, each pair of end portions 27 along bend line 23*a* in FIG. 2 are formed using the die set of FIGS. 3-5 and a single stroke of the dies.

In FIGS. 3, 4 and 5, the end portion forming turret punch die set can be seen to be comprised of an upper die block body 51 that carries two male dies 52, which are mounted for reciprocal movement in bores 53. Female die block 54 is positioned in registered relation to male die block 51, and ends 56 of male dies 52 and recesses 57 in female die block 54 are cooperatively formed so that downward displacement of the male dies 52 will produce the downwardly displaced quarter circle end slit portions 27 of FIGS. 2 and 2A.

Figure 15:
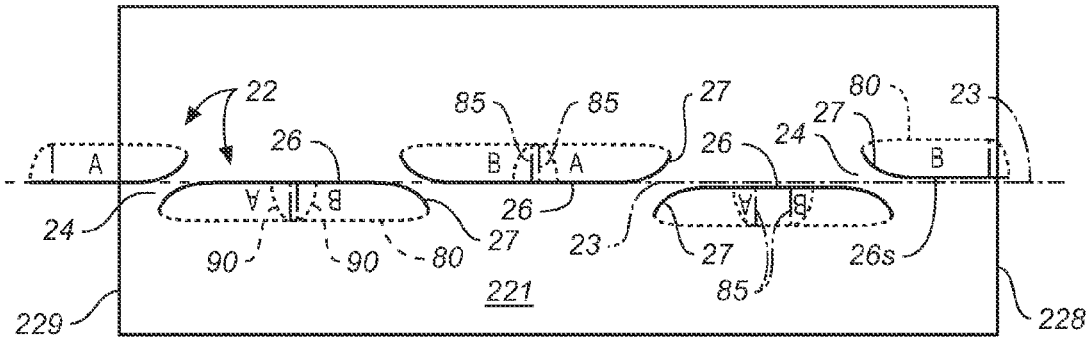
FIG. 15 is a top plan view of a sheet of material illustrating an alternative embodiment of the process of the present invention.
Figure 16:
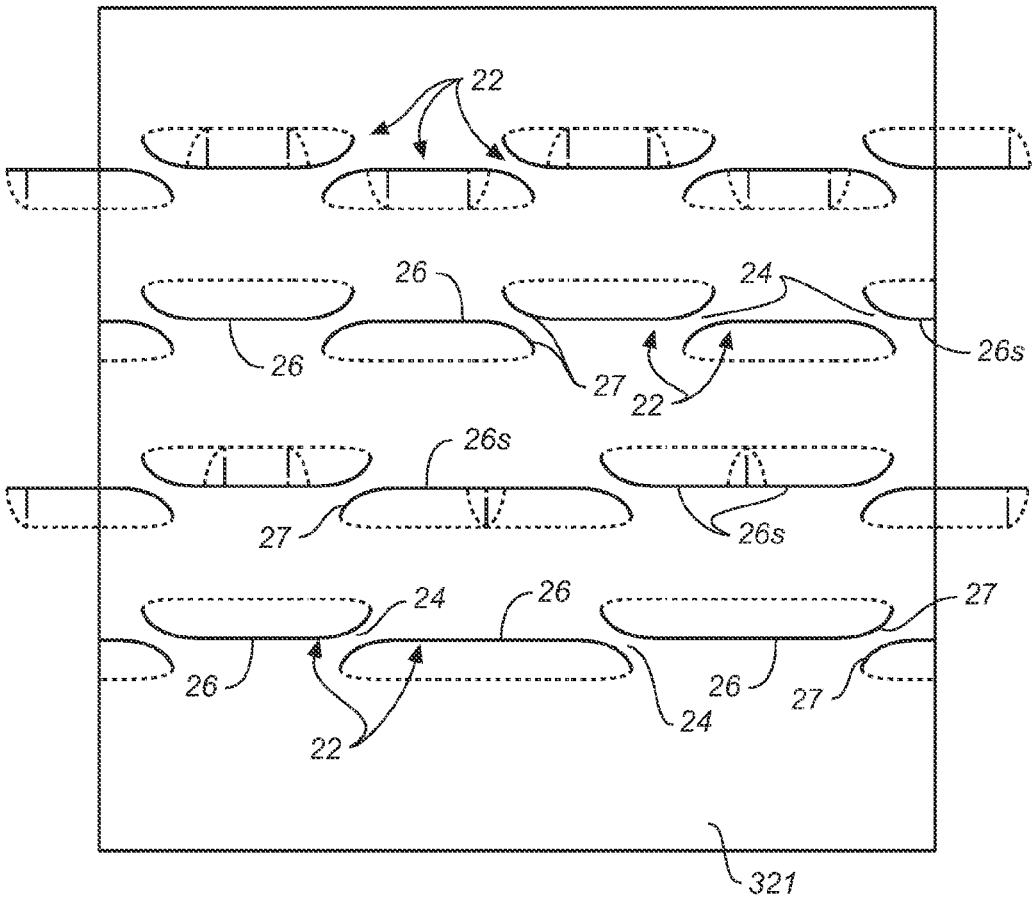
FIG. 16 is a top plan view of a sheet of material illustrating a further alternative embodiment of the process of the present invention.
Figure 17:
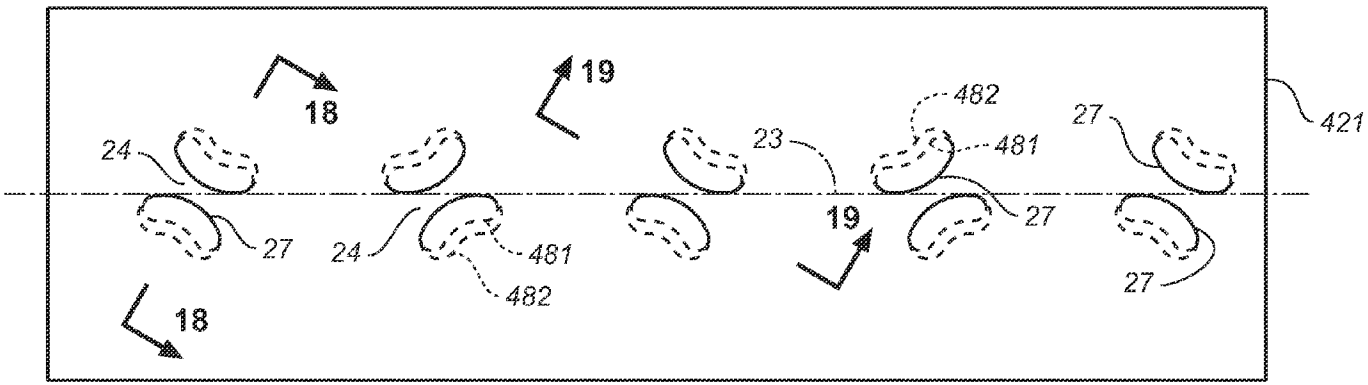
FIG. 17 is a top plan view of a sheet of material showing a further alternative embodiment of the process of the present invention.

It is a particular advantage of the present invention that the same end portion forming die set 51/54 can be used to make pairs of end portions 27 which define bending straps 24 that are skewed in alternating directions, simply by rotating die set 51/54. In the bend-controlling slits illustrated in FIG. 2, end portions 27 diverge from the bend line in a quarter circle arc having an included angle of about 90 degrees. Die set 51/54, therefore, can be used to punch a pair of end portions 27 and then can be rotated by about 90 degrees to punch the next set of bending strap defining end portions 27. The bending straps will have centerlines 25 (FIG. 2A) skewed in alternating directions along the bend line. In FIGS. 15, 16 and 17, the arcuate end portions of the slits have included angles of only about 60 degrees, and a turret punch die set equivalent to the embodiment of FIGS. 3-5 for these end portions would only need to be rotated by about 60 degrees.

As schematically shown in FIG. 2, a broken line circle 61 shows end portion forming die set 51/54 in a position to produce a first pair of end portions 27 defining a first bending strap 24, while the circular broken line 62 shows the end portion forming die set 51/54 rotated by about 90 degrees and in a position to form a second pair of end portions 27 defining an oppositely skewed bending strap 24. If the sheet of material 21 is translated or moved, which is the conventional preferred approach, turret punch die set 51/54 would remain in the same position and simply be rotated by about 90 degrees between punching strokes. The amount of translation of sheet 121 along bend line 23*a* determines the spacing between pairs of end portions and eventual the overall length of the bend-controlling structures.

It will be apparent, therefore, that the spacing between bending straps 24, and thus the length of slits 22, can be easily adjusted so as to cause the central portions 26 of the bend-controlling slits to terminate at edges 128 and 129. Similarly, not all spacings need to be equal so that bending straps 24 can be concentrated proximate a sheet edge or straps can be moved away from weakened structural features, such as openings (not shown) proximate bend line 23*a* to more ideally center the bend-controlling structures and straps and to tailor the folding forces along the bend line.

It is also possible to change the shape of end portions 27, but this requires die sets 51/54 having different shaped male die ends 56 and mating female die recessions 57, for example, a die set 51/54 that forms about a 60 degree arcuate end portion. Moreover, if one wants to increase the transverse width of bending straps 24 while retaining the quarter circle shape, the distance between bores 53 in which dies 52 reciprocate and the distance between recesses 57 in the female die will have to be changed. As above noted, this can be done by increasing the jog distance between slits across the bend line or by moving end portions 27 longitudinally along the bend line, or both. Nevertheless, by having a plurality of sets of end portion forming dies 51/54, various end portion configurations, bending strap widths and strap positions can be tried so as to enable bending straps 24 of the bend-controlling structures to meet the loading criteria for the resultant three-dimensional product. While a plurality of end portion forming dies is required, separating end portion formation from the formation of the central portion of the bend-controlling slits, grooves or displacements can greatly reduce the number of permutations possible Such separation removes the length of the central portion of the bend-controlling structure as a variable for creation of the desired configurations and thereby reduces the inventory of die sets required to produce a large number of bend-controlling structure lengths and strap configurations.

Returning now to FIGS. 2 and 2B, completion of the bend-controlling structures 22 in sheet 121 can be described. In FIG. 2 along bend line 23*b* the pairs of end potions 27 which define bending straps 24 have been connected on alternating sides of the bend line by central portions 26 that have been punched into sheet 121. In the illustrated set of bend-controlling slits 22, however, central portions 26 actually fall on and are superimposed on bend line 23*b*. As used herein, therefore, the expression "alternating sides" of the bend line includes the conditions in which central portions 26 are spaced laterally from the bend line or are superimposed on the bend line with end portions 27 extending away from alternative sides of the bend line.

Figure 2B:
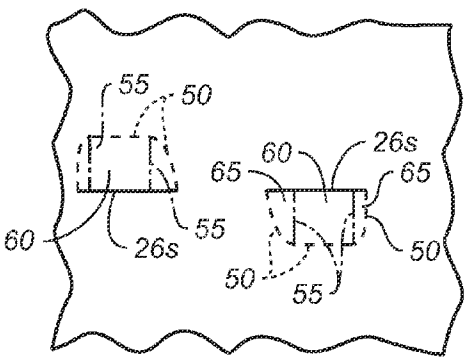
FIG. 2B is a fragmentary, enlarged, top plan view of the impressions made in a sheet of material using a central portion die set in implementation of the second step of the process of FIG. 2.
Figure 2A:
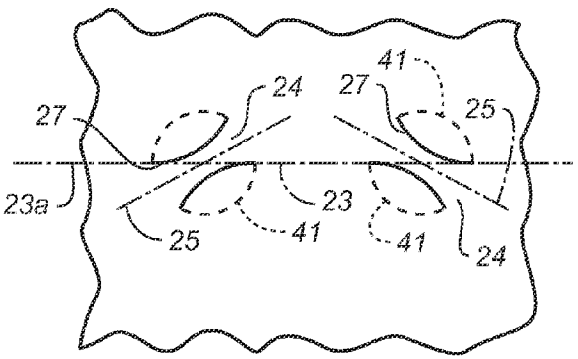
FIG. 2A is a fragmentary, enlarged, top plan view of the impressions made in a sheet of material using an end portion forming die set in implementation of the first step of the process of FIG. 2.

FIG. 2B illustrates the impressions made on a sheet of material by a turret punch die set (FIGS. 7-9) that punches segments 26*s* of central portion 26 of the bend-controlling structure into the sheet material. Central portion segments 26*s* are again illustrated as being punched into the page, with broken line 50 indicating where the sheet material begins tilting down from the plane of the rest of the sheet. Phantom lines 55 show a change in slope between the central tilted planar area 60 and the end areas 65 of the central portion segment impression.

Each segment 26*s* of central portion 26 can be seen to be added together with other segments along bend line 23*b* to connect end portions 27 and produce the total central portion 26 of the bend-controlling structures. In FIG. 2 the first full slit central portion 26 on the left side of the sheet along bend line 23*b* is formed by three central portion segments 26*s*, while the next full central portion 26 is formed by five central portion segments 26*s*.

The completed, punched, bend-controlling structures 22 are shown along bend line 23*c* in FIG. 2. The broken lines 70 show the approximate combined periphery along the bend-controlling structures at which the sheet material would be tilted down and out of the plane of sheet 121.

In FIGS. 7-9, central portion forming turret punch die set, comprised of a male die block 71 and a female die block 74, is shown. A single male die 72 is mounted for reciprocation in bore 73 and has an end 76 that cooperates with a recess 77 in female die block 74 to produce central portion segment 26*s* of FIG. 2B.

While it is possible for the central segment 26*s* to have a length dimension which will connect end portions 27 with a single punching stroke, in most instances several central strokes are required to complete the entire length of central portion 26, as illustrated along bend line 23*b*. In one embodiment of the process of the present invention, therefore, a single central portion forming die set 71/74 is incrementally linearly advanced, translated or walked down the bend line using multiple strokes in order to achieve the desired length of central portion 26. Many turret punches include a rapid stroke mode. Thus, it is quite feasible to use a central portion die set 71/74 that only forms a segment 26*s* of central portion 26 and linearly move or translate the sheet in short steps while the punch is in rapid stroke mode to walk the die set from one end portion 27 to the other.

As will be seen from FIG. 8, it is preferable that the male die tool 72 have an end 76 which is sloped like the bow of a boat in the direction of advancement between end portions so as to gradually enter the sheet of the front end on the downward stroke. Additionally, in order to allow the central portion 26 to terminate at edges 28 and 29 without extending into adjacent sheet areas, die 72 preferably is formed with a relatively squared off or near perpendicular stern end 91. As can be seen at the left edge 129 along bend line 23*b*, the relatively squared off bow does not extend very far beyond edge 129 and will not damage or slit very far into material adjacent to edge 129. This allows closely side-by-side areas of sheet 121 to be used to form side-by-side parts with very little waste.

The formation of central portions 26 using multiple die strokes can be further described by reference to FIGS. 2 and 13-15. In FIG. 2 the central portions 26 connecting the upwardly diverging end portions 27 are formed by walking the die set 71/74 from left to right along bend line 23*b*, while the central portions 26 of the downwardly diverging end portions 27 are formed by rotating die set 71/74 by 180 degrees and walking the die set from right to left along bend line 23*b*. As above noted, in each case it is preferred that the sheet be moved to effect the walking of the die set.

Considering the central bend-controlling structure formed from five overlapping central portion segments 26*s*, it will be seen that the stern or butt end 91 of male die 72 is positioned proximate, but slightly overlapping the point at which end portion 27 becomes tangent to bend line 23*b* and the desired central portion. This is shown at point 93 in FIGS. 2 and 11. While it is preferable that central portion segment slightly overlap the end portion tangent point 93, it has been found that such overlap is not an absolute requirement. In fact, the central portion segment 26*s* can even be spaced slightly from end portion 27, and the edge-to-face engagement along the central portion of the bend-controlling structure will force the end portions 27 and central portion segments 26*s* to bend the sheet as though they were connected. In some cases, the small unsevered space between the end portions and the central portions will crack or "fail" across the small unconnected length and complete the bend-controlling structure.

In any event, when a die stroke occurs, only a segment 26*s* of the overall central portion 26 of slit 22 will be formed, with prow 92 of die 72 only partially entering sheet material 121 at a position 96, which is well short of end portion 27 at the other end of slit 22. One of the sheet and the die set 71/74 will then be incrementally translated or moved, most preferably sheet 21 is translated, in the direction of arrow 97 in FIG. 12. A second stamping stroke will then be executed with die 72 so as to lengthen the central portion by another linear slit segment 26*s* to position 99 shown in FIG. 12. In the illustrated sequence, sheet 21 is again incrementally linearly moved in the direction of arrow 97 and a third stroke of die 72 is employed. After two more translations and strokes, central portion segments 26*s* connect end portions 27. Depending on the length of the central portion 26, as many strokes of the die as necessary will be made until the central portion 26 is completed, preferably while using the rapid stroke mode of the punching or stamping equipment. In FIG. 14 sheet 121 can be seen to have end portions 27, as well as central portion 26, formed therein to produce the desired bend-controlling structure 22.

As above noted, die set 71/74 is advanced from left to right along sheet 21 to form the central connecting portions 26 of slits 22 having end portions 27 which diverge downwardly from the bend line. For end portions 27 which diverge upwardly from bend line 23, the die set will be rotated by 180 degrees and advanced from right to left in FIG. 2. This allows the near vertical butt or stern portion 91 of die 72 to enter sheet 21 exactly at edge 128 for the downwardly diverging slits and exactly at sheet edge 129 for the upwardly diverging slit end portions. Thus, contiguous areas of the sheet, which do not have slits 22 will not be damaged by the central portion forming die set, and yet, the central portions 26 of the slits can be positioned to extend to the sheet edges. At the same time, considerable variation and the length of slits 22 can be accommodated with a single set 71/74 of central portion forming dies.

In the most preferred form of the process of the present invention, end portions 27 defining bending straps 24 are formed as a first step of the process and central portions 26 are then formed to connect pairs of end portions to complete the desired slit or bend controlling structure. Thus, the preferred process is strap-centric in nature. The configuration and positioning of the bending straps are selected to give the desired folding forces, product strength and fatigue resistance, and bend accuracy. Once the strap configurations and spacings are selected, the central portions connect the bending strap defining end portions to complete the bend-controlling structures.

It will be understood, however, that it also would be possible to form the central portions 26 first and thereafter form end portions 27, once the spacing and shape of the bending straps has been selected. The central portions, when such an alternative approach is taken, would be positioned and have a length that would result in their connecting with end portions 27. While the central portions would be formed first in this alternative version of the present process, the spacing of the bending straps and the bending strap width has to be determined before the punching process for the central portions is actually undertaken. The spacing of the bending straps and the bending strap width are discussed in the previously filed related applications which are incorporated herein by reference. Thus, the shape and spacing of the bending straps will still control the length of central portions 26, even though the central portions 26 are stamped first into the sheet of material.

It also should be appreciated that in most cases bend-controlling structures 22 preferably are not laid out on bend line 23*b* such that the prow 92 of die 72 extends beyond edge 128. Since prow 92 gradually penetrates the sheet of material, it would extend beyond edge 128 an undesirably long distance in order to penetrate completely through the sheet at edge 128. This will result in undesirable scrap as a result of penetration of the sheet beyond edge 128. Obviously if there is no material adjacent to edge 128, this problem will not exist. But, if side-by-side areas of the sheet are present, then selecting the number and length of bend-controlling structures 22 so that the upwardly diverging slits 22 have a central portion 26 extending to edge 129 and the downwardly diverging structures have a central portion 26 extending to edge 178 will reduce scrap loss.

In FIG. 2 pairs of end portions 27 are created by a single punching stroke using the turret punch die set of FIGS. 3-5. It also is within the scope of the present invention to use a die set that produces only one end portions 27 for each punching stroke. This processing approach has the disadvantage of requiring more strokes and manipulation of the sheet of material, but it has the advantage of reducing the inventory of die sets required to produce a wide range of bend-controlling structures.

When a single end portion is formed for each punching stroke; the bending strap width can be varied without the need of a new die set with a wider spacing between the pairs of punching dies 52. In a process which forms the bend-controlling structures by forming a single end portion 27 for each die stroke, a first end portion 27 is formed by a die stroke, the sheet of material is translated to the opposite end of the bend-controlling structure while the punching die is rotated by 90 degrees, and then the second end portion 27 is formed by another punching stroke. This process proceeds down one side of bend line 23, and then is repeated for the bend-controlling structures on the opposite side of the bend line.

A one-end-portion per one-stroke approach allows the bending strap widths to be varied simply by varying the positioning of the punching die to increase or decrease the jog distance and/or the position along the bend line. Thus, a plurality of die set pairs with differing spacing between the pairs of end portions forming punching dies 52 is not required.

It should be noted that it also would be possible to form one end portion 27 with a single stroke and then move the sheet of material (or die set) to position the die set to punch a second end portion 27 by a second stroke across the bend line, rather than down the bend line. The punching die set would be rotated by 180 degrees for the 90 degree included angle of end portions 27 in FIG. 2 when used to punch the end portion 27 across the bend line. This would result in a pair of end portions 27 defining the desired bending strap 24 being formed, as shown on bend line 23*a* in FIG. 2, using two punching strokes.

In either of these one-end-portion per one-stroke processes the end portions would again preferably be connected by a central portion die set, such as that of FIGS. 7-9, which punches a central portion segment 26*s*. The central portion segment 26*s* can be long enough to connect end portions 27 by a single stroke, or can be shorter and require a plurality of strokes and walking or translation of the sheet (or die set) to form the complete central portion 26, as above described.

Figure 15A:
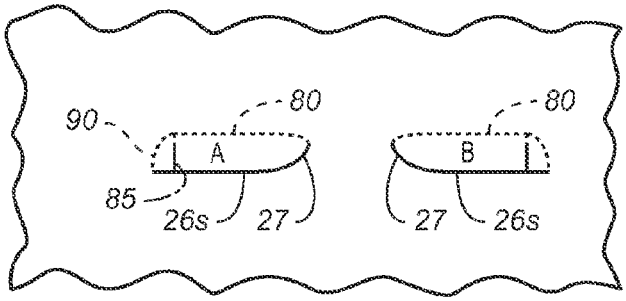
FIG. 15A is a fragmentary, top plan view of the impressions made by a right-hand die set and a left-hand die set used to make the bend-controlling structures of FIG. 15.

A further alternative embodiment of the bend-controlling structure forming process and resulting sheet of the present invention can be described by reference to FIGS. 15 and 15A. In FIG. 15 a sheet of material, generally designated 221, is shown in which bend-controlling structures 22 are formed along a bend line 23. Instead of separating the end portions of the structures completely from the central portion, in the embodiment of FIGS. 15 and 15A punching or stamping die sets (not shown) are used in which end portions 27 are connected to a relatively long central portion segment 26*s*. Moreover, a die set which forms a right-hand end of the structures 22, namely, impressions A, as well as a die set which produces a left-hand end of bend controlling structures 22, namely, impression B, are employed. Again, the broken line 80 is the peripheral boundary line at which the punched sheet begins to tilt down or up from the page. Phantom line 85 is where the material tilts back to stern end 90 of the impression.

In FIG. 15 use of the right-hand and left-hand die sets to form bend controlling structures 22 can be seen. The center bend-controlling structure 22 can be seen to be composed of two punch strokes, one by the die set producing impression A and the other by the die set producing impression B. Stern ends 90 of impressions A and B are aligned but longitudinally overlapping by an amount that positions tilt lines 85 in a very slightly overlapped condition. This produces substantially the maximum continuous length for central portion 26 that can be produced by the impressions A and B.

For bend-controlling structure 22, which is inverted and to the right of the central bend-controlling structure 22, the die strokes have been overlapped by a greater distance to shorten the length central portion 26. Again, the bend-controlling structures have been positioned so as to cause central portions 26 to extend to edges 228 and 229 of sheet 221. The termination at edge 228 is normally preferred over that of edge 229, since there is an extension of impression A far into the area adjacent to edge 229. This could be corrected, for example, by increasing the overlap of the central bend-controlling structure 22 to pull in, or shorten, the overlap of impression A at edge 229 so that it would be positioned as shown for edge 228.

In terms of the processing sequence, one series of impressions, for example, impressions A would be formed all along bend line 23, and then the dies rotated to form the same impressions for the downwardly diverging A impressions. The die set for the B impression would then be used to complete each bend-controlling structure 22 along one side of the bend line and then the die set would be rotated by 180 degrees after the first side is completed to complete the other side. This also can be accomplished at two progressive punching stations or stages.

It also should be noted that bending strap 24 proximate edge 228 is wider than bending strap 24 proximate edge 229. This has been accomplished by increasing the jog distance of the bend-controlling structures from bend line 23, and can be used, for example, to provide greater strength for the product to withstand greater loading along edge 228.

Figure 16A:
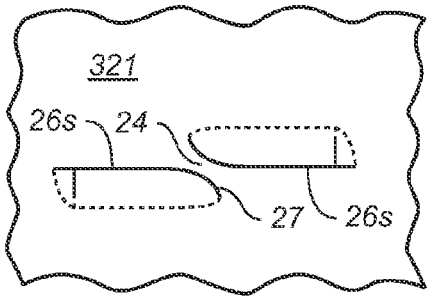
FIG. 16A is a fragmentary, top plan view of the impression made by one die set used to form a portion of the bend-controlling structures of FIG. 16.
Figure 16B:
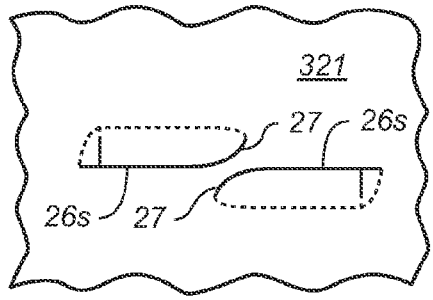
FIG. 16B is a fragmentary, top plan view of the impression made by a mirror image die set to that of FIG. 16A which is used to form the remainder of the bend-controlling structures of FIG. 16.

Turning now to FIGS. 16, 16A and 16B, still a further embodiment of the process and resulting sheet of the present invention is illustrated. Sheet material 321 is shown in which a plurality of bend-controlling structures 22 have been formed by stamping or punching on alternating sides of bend lines 23. In a manner similar to the embodiment of FIG. 1 each die set (not shown) produces a pair of impressions in which end portions 27 are stamped to define bending straps 24 of a desired configuration. Additionally, however, in a manner similar to the embodiment of FIGS. 15 and 15A, the die sets produce impressions in which central portion segments 26*s* are connected to end portions 27. The complete bend controlling structure 22, therefore, is again created by aligning and overlapping central portion segments 26*s*.

As will be seen from FIGS. 16A and 16B, this approach also requires right-hand dies and left-hand dies because merely rotating one set of dies by 180 degrees will not allow a complete bend-controlling structure 22 to be formed. Thus, as shown in FIG. 16A, the right-hand impression (bending strap 24 skewed downwardly to the right) has a normal line thickness, while in FIG. 16B a bolder line thickness is used for the left-hand impression (bending strap 24 skewed downwardly to the left). That (bold line/normal line graphic) convention is employed in FIG. 16 to show how the right-hand and left-hand die sets are used to produce completed punched bend-controlling structures 22.

In FIG. 16 it also will be seen that the top bend line shows the two impressions with a large overlap so that the resulting bend-controlling structure 22, the next bend line down, can be seen to have minimum central portions 26 for the die sets producing the impressions of FIGS. 16A and 16B.

For the bottom two bend lines on sheet 321 the overlap has been reduced for the central bend-controlling structures, which have substantially a maximum central portion 26 for the die sets producing the impressions of FIGS. 16A and 16B has resulted. An intermediate central portion length is shown for slits 22 at the left side on the bottom two lines of sheet 321.

As was the case for the FIG. 15 embodiment, staged or progressive die stations are preferably used, with the right-hand impressions being formed at one stage and the left-hand impressions being formed at another stage.

It should also be noted that either of the processes which produce the punched sheets of FIG. 15 or 16 can be combined with the use of a central portion forming die set. Thus, still longer bend-controlling structures can be created by punching the end portions 27, with the connected central portions, at a spaced apart distance along bend line 23 and then connecting the partial central portions using a central portion die set that produces a central portion segment 26*s* as required to bridge the gap between the end portion dies.

FIGS. 17-21 illustrate a punched sheet of material and a turret punch die set that can be used to form bend-controlling structures in a manner analogous to that described in connection with FIGS. 1-5. Again, pairs of end portions 27 are punched into sheet 421. End portions 27 will be connected by a central portion forming die set, not shown.

In FIGS. 18-21, however, die set 451/454 can be seen to be configured in a manner which is different from die set 51/54 of FIGS. 3-5. As best may be seen in FIG. 19, male dies 452 have a width dimension which is less than the recess 457 in female die body 454. As the male dies 452 are displaced downwardly into sheet 421, the inner edges are closely aligned with edges 461 in recesses 457 so that sheet 421 is sheared at 462. The outer edges 463 of male dies 452 are spaced laterally from the outer edges 464 of recess 457. The spacing produces a shoulder 466 in sheet material 421, rather than shearing the sheet at 466. Shoulder 466 tends to force male die inner edge 460 against female die edge 461. By urging edges 460 and 461 together as male die 452 is urged downwardly, the shearing is more easily accomplished and it is believed that the closely opposed shearing edges 460 and 461 will remain sharper for more punching strokes. Moreover, the dies 452 have ends which are easier and less costly to sharpen using a grinder. Thus, the cost of sharpening the punching dies 451/454 should be significantly reduced as compared to the cost of sharpening punching dies 51/54.

It also should be noted that for many carbon steels male dies 452 need only penetrate sheet 421 by about 70 to 80 percent of the sheet thickness to completely shear through sheet 421 along end portion line 27. Such depth of penetration is shown in FIG. 20.

FIG. 17 shows the completely sheared end portions 27 as a solid lines, while the rounded shoulder 471 of the impression is shown as a broken line 481 and the downwardly displaced shoulder 472 also is shown as broken line 482.

Figure 20:
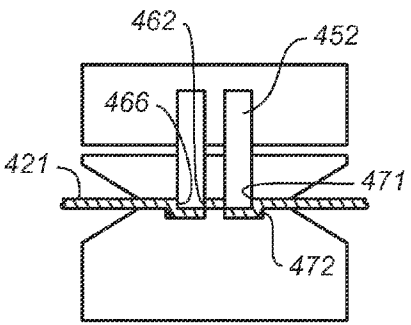
FIG. 20 is a side elevation view, in cross section, corresponding to FIG. 19 and showing punching of a sheet of material.
Figure 21:
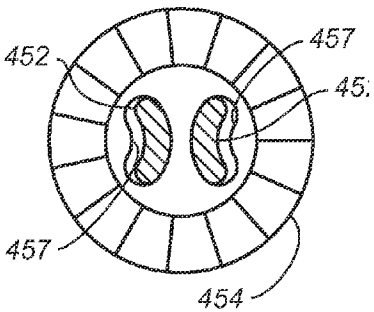
FIG. 21 is a bottom plan view of the die set taken substantially along the plane of line 21-21 in FIG. 19.

Finally, in FIG. 21, the kidney bean shape of male dies 472 and the over-sized similarly shaped recesses 457 can be seen which produce the impressions of FIG. 17. These kidney bean shapes have not been attempted to be shown in FIGS. 18-20 for the sake of clarity.

Figure 18:
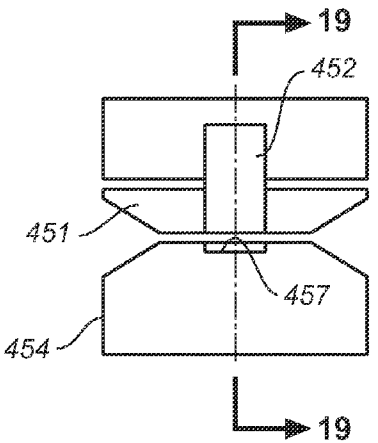
FIG. 18 is a side elevation view, in cross section, of the turret punch die set used to make the impressions of FIG. 17, taken substantially along the plane of line 18-18 of FIG. 17.
Figure 19:
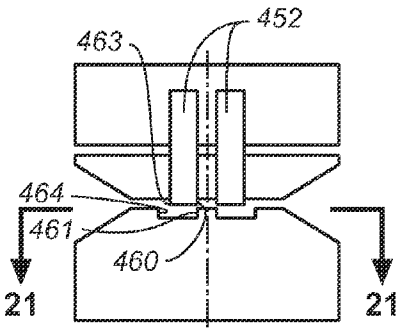
FIG. 19 is a side elevation view, in cross section, taken substantially along the plane of line 19-19 in FIGS. 17 and 18.

The dies of FIGS. 18-20 can be used in the same manner as those of FIGS. 3-5, and there also would be an equivalent set of dies (not shown) for formation of central portion segments that connect end portions 27. The dies of FIGS. 18-20 would be used in a staged turret punching process, but they also are instructive as to how a modular die set assembly could be created to practice the present invention, as is described in more detail in connection with FIGS. 22-30B.

In FIG. 22 a die set assembly, generally designated 500, is shown in which one die block 551 caries a male die 552 while a second die block 550 carries a female die 554. Die blocks 551 and 550 can each be formed with a groove 501 into which modular insert die members are secured, for example, by O-rings 503, securement members 504 and fasteners 506.

Both male die 552 and recess 557 preferably have kidney bean shapes similar to that shown in FIG. 21, but with a segment of the structure central portion attached, as was the case for the dies producing the punched sheets of FIGS. 15 and 16. Recess 557 is oversized as compared to male die 552 so as to produce a shoulder 566 in sheet 521, which, in turn, pushes the inner edges of the male and female dies together, as described in connection with FIGS. 18-20.

In the embodiment of FIGS. 22 through 25B, a plurality of modular die inserts are employed to build or create a modular die set in blocks 550 and 551 that will produce the bend-controlling structures 22 of the desired shapes and spacings along a bend line 23. FIG. 23 shows the female die inserts 511, 512, 513 and 514 for die block 550 with their recesses 557 and the corresponding male die members 552, in cross section, as taken substantially along the plane of line 23-23 in FIG. 22.

Inserts 512 and 513 can be seen to be used to create central portion segments, while modular inserts 511 and 514 are used to form end portions 27. When placed in side-by-side abutting relation, as shown in FIG. 24, inserts 511-514 created a modular die set that can be secured in the grooves 501 of assembly 500 to form the desired bend-controlling structures.

Figure 24:
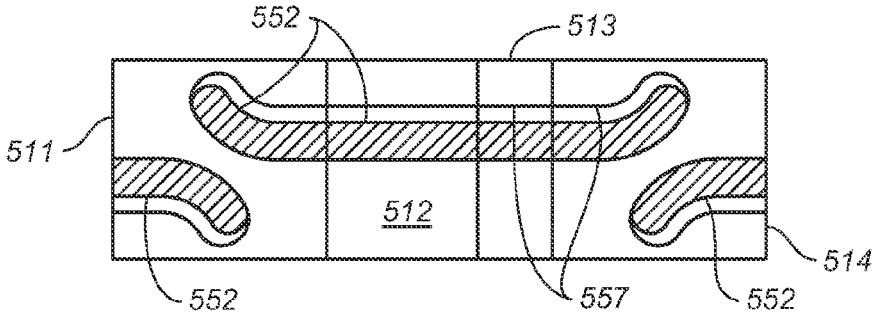
FIG. 24 is a top plan view of the modular dies of FIG. 23 mounted in side-by-side relation as they would be used to form a complete bend-controlling structure and portions of adjacent bend-controlling structures.
Figure 25:
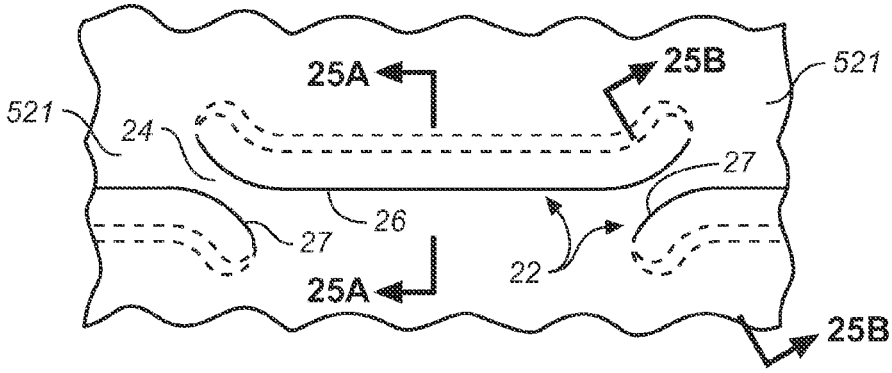
FIG. 25 is a fragmentary top plan view of a sheet of material formed with bend-controlling structures using the modular dies of FIG. 24.
Figure 25A:
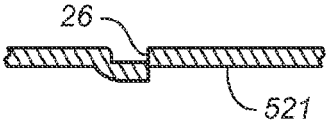
FIG. 25A is a fragmentary, side elevation view of the sheet of FIG. 25 taken substantially along the plane of line 25A-25A of FIG. 25.
Figure 25B:
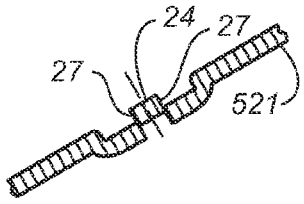
FIG. 25B is a fragmentary, side elevation view of the sheet of FIG. 25 taken substantially along the plane of line 25B-25B of FIG. 25.

The sheet 521 which has been punched using the assembly of modular die inserts of FIG. 24 is shown in FIGS. 25, 25A and 25B. As will be appreciated, the length of central portion 26 of each structure 22 can be changed simply by adding or subtracting modular central portion inserts, such as, modular insert members 512 and 513. End portion inserts can be seen here to include a short segment of the central portion so that inserts 511 and 514 could be placed together without inserts 512 and 513 for structures with short central portions. Moreover, the short central portion segments, or inserts 511 and 514, will be seen to align with the central portion segments formed by inserts 512 and 513.

The shape and width of bending straps 24 similarly can be changed by substituting different shaped modular inserts 511 and 514 for the end portions. A plurality of bend-controlling structures 22, therefore, can be built along grooves 501 by using modular die inserts which extend down the length of bend line 23 so as to achieve the various spacing goals and edge effect accommodations, as described above.

Another embodiment of a modular die set insert assembly suitable for stamping or punching bend-controlling structures 22 can be seen by reference to FIGS. 26-30B. These modular inserts also would be used in a punching or stamping assembly 500, as shown in FIG. 22.

Figure 26:
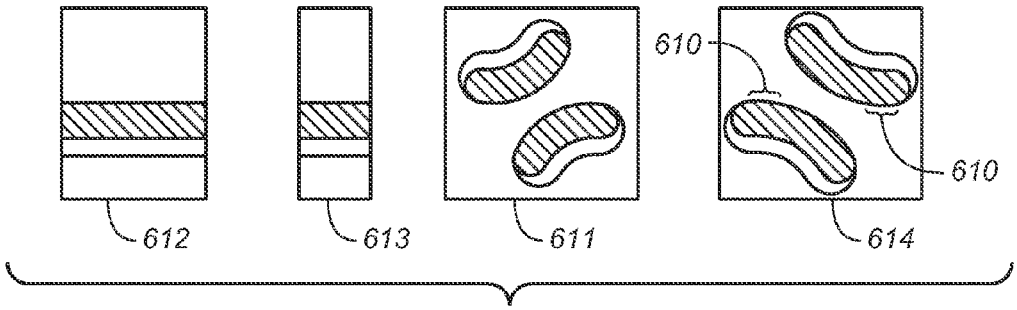
FIG. 26 is a top plan view of an alternative embodiment of modular dies usable in the die set assembly of FIG. 22 prior to mounting the dies in the die set.

FIG. 26 shows four insert members 611, 612, 613 and 614 which can be used to form the end portions and central portion of bend-controlling structures 22. The end portion forming inserts 611 and 614 have the kidney bean shape of turret punch dies 451/454 as shown in FIG. 21. Modular insert 614, however, is shown as having an extension or straight line segment 610 which will cause more of an overlap of the impressions produced with the central portion impressions of insert members 612 and 613. This is preferred by optional since any gap between the tangent point of the end portion impression and the central portion impression will tend to be forced by the edge-to-face engagement to behave as though there is no gap or even shear across any gap, as noted above. Modular inserts 611 and 614 include pairs of end portions 27 that will be formed along bend line 23 at the desired spacings without the need for rotating the dies, as was done in connection with the turret punch embodiment of FIG. 1.

In the modular embodiment of FIGS. 26-30B, however, a two stage punching or stamping process is employed. Thus, in FIG. 27 inserts 611 and 614 are spaced from each other by spacers 616 (die "furniture"), depending upon the desired spacing of the resulting bend-controlling structures. It should be noted that in FIG. 27 insert 614 does not have extensions 610 as shown in FIG. 26, but is a mirror image insert of insert 611.

Figure 27:
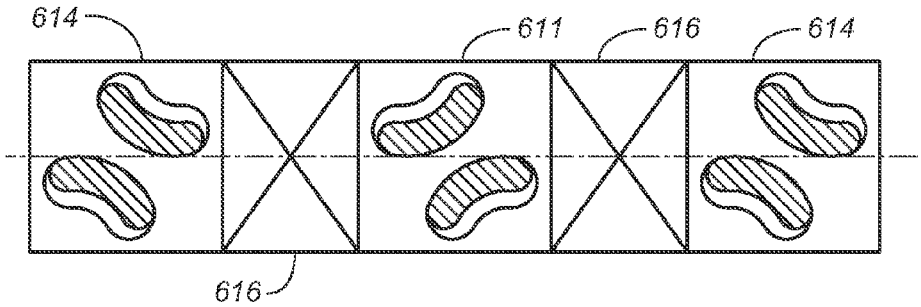
FIG. 27 is a top plan view of end portion modular dies mounted in side-by-side relation with spacers as they would be used in the die set assembly of FIG. 22 to form end portions of the bend-controlling structures.
Figure 28:
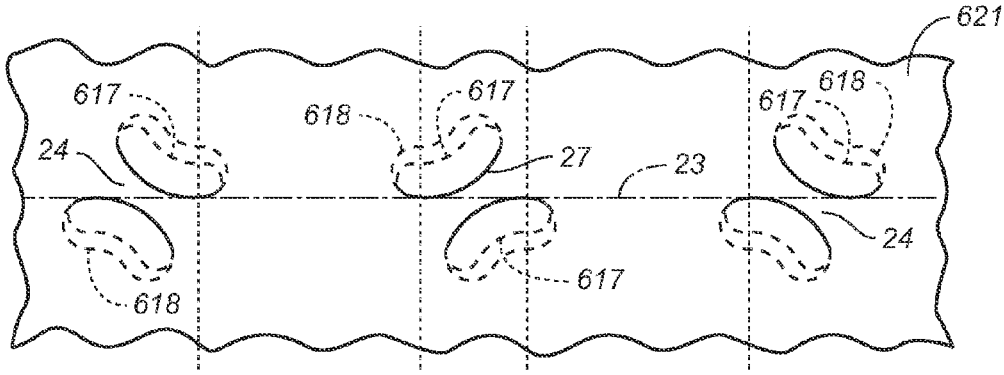
FIG. 28 is a top plan view of a sheet of material showing the impressions made by the modular dies of FIG. 27.

Sheet 621 is then punched using the assembly of FIG. 27 in order to produce pairs of end portions 27 along bend line 23, as shown in FIG. 28. The solid lines are slits that penetrate through sheet 621, while the broken lines 617 are shoulders 666 (FIG. 30B) and broken lines 618 are shoulders 667.

Figure 29:
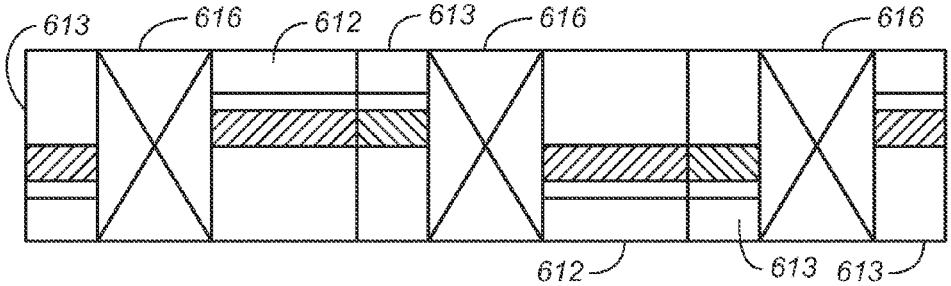
FIG. 29 is a top plan view of central portion modular dies mounted in side-by-side relation with spacers as they would be used in the die set assembly of FIG. 22 for central portions of the bend-controlling structures.
Figure 30:
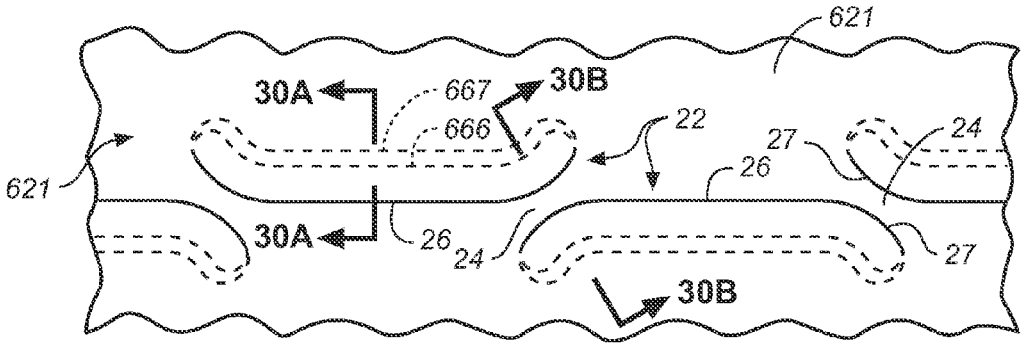
FIG. 30 is a top plan view of the sheet of material of FIG. 28 showing the impressions made using the modular dies of FIG. 29 and the modular dies of FIG. 27.
Figure 30A:
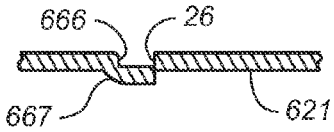
FIG. 30A is a fragmentary, side elevation view of the sheet of FIG. 30, taken substantially along the plane of line 30A-30A in FIG. 30.
Figure 30B:
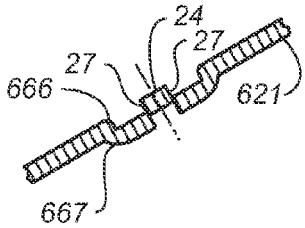
FIG. 30B is a fragmentary, side elevation view of the sheet of FIG. 30, taken substantially along the plane of line 30B-30B in FIG. 30.

At a second punching stage, a second assembly of die inserts, shown in FIG. 29, is employed to connect end portions 27 and complete bending structures 22. Thus, inserts 612 and 613 can be assembled with spacers 616 so as to connect end portions 27. The modular inserts 612 and 613 have a geometry which allows them to be inverted and used to connect end portions on both sides of bend line 23.

Obviously, spacers 616 and the modular inserts are selected to match the spacing required to connect end portions 27, but since end portion forming inserts 611 and 614 do not include a central portion segments, as was the case for inserts 511 and 514, the central portion inserts 612 and 613 preferably abut and possibly overlap of the impressions formed by the end portion forming inserts 611 and 614. This overlap should be sufficient for the central portion 26 to be at least tangent at points 618 to the end portion impressions 27. The result can be seen in FIG. 30 as a continuous bend-controlling structure in which the severed slits are shown in solid lines and the opposing shoulders 666 and the shoulders 667 shown in broken lines.

One of the advantages of a two stage process over that of the one stage approach is that less punching force will be required for each stroke of the two stages. Obviously, disadvantages can be the requirement for sheet manipulation between the two stages and a duplication of the punching equipment.

Figure 31:
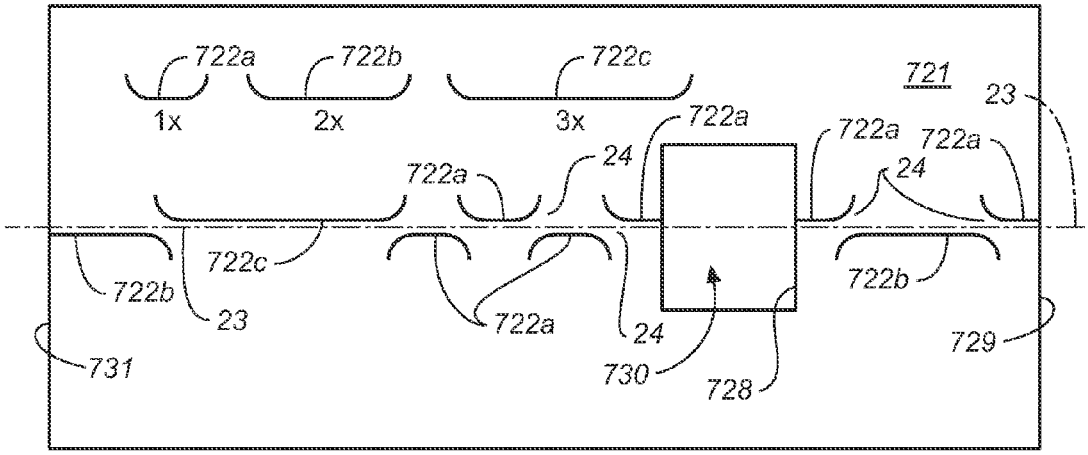
FIG. 31 is a top plan view of a sheet of material showing the bend-controlling structures formed by using three die sets producing complete bend-controlling structures of differing lengths.

Turning now to FIG. 31, a further technique for reducing the punching die set inventory required, while still enabling the desired bend-controlling structure configurations and positioning, can be described.

Sheet 721 is formed at the top of the sheet with three die impressions or punch shears 722*a*, 722*b* and 722*c*, which each were made by a single die set and die stroke. Thus, each of impressions 722*a*-722*c* are complete bend-controlling structures formed by one punching stroke. It will be seen that these bend-controlling structures have three different length dimensions along the bend line, with shear 722*a* being the shortest, shear 722*b* being twice as long as impression 722*a* and shear 722*c* being three times as long as shear 722*a*. By providing sets of punching dies which will produce complete bend-controlling structures of differing lengths, it is possible to make a selection of the combination of dies used, from a finite set of 3 (or a set of 4, or 5, or more), which will allow substantially the desired or ideal positioning of, and configuration for, the bending straps.

Considering bend line 23 in FIG. 31, it will be seen that the desired bend extends through an opening 730 in sheet 721. On the right side of opening 730, two dies which produce a 722*a* shear of the sheet are employed at edges 728 and 729, while an intermediate bend-controlling structure shear 722*b* of twice the length is positioned between the 722*a* shears. This results in the central portions of shears 722*a* running or extending out to edges 728 and 729, and the longer sheared bend-controlling structure 722*b* completing the desired bend-controlling structures along bend line 23 to the right of opening 730.

On the left side of opening 730, a different selection of the set of dies producing impressions 722*a*, 722*b* and 722*c* has been made. Thus, a plurality of short 722*a* impressions, which result in a plurality of bending straps 24 close to opening 730, are employed. In the middle of the sheet, longer impressions 722*c* are employed, and an impression or shear 722*b* is used at edge 731.

The lateral spacing, jog distance, between bend-controlling structures along bend line 23 also can be varied as required. While impressions or shears 722*a*, 722*b* and 722*c* are here shown as having a 1×, 2× and 3× length relationship, other multiples, including fractional multiples, could be employed, as well as a greater number of lengths in a given set of dies to select from. Additional, similarly formed, die sets are required if the bend-controlling end portions are to vary, for example, be arcs with included angles of 60 degrees or be fatigue resistant arcuate ends that curl back on themselves.

Having set forth several turret punch and modular die combinations that can be used to produce bend-controlling structures in sheet material, the use of these die combinations in a flexible manufacturing or prototyping process can be described.

As a first step, a configuration and spacing of bending straps 24 along a bend 23 line for the sheet can be selected. As used herein, the expression "configuration" shall mean the shape and transverse spacing between pairs of end portions 27. The longitudinal spacing along bend line 23 obviously means the location along bend line 23 at which end portions 27 on the same bend-controlling structure 22 are spaced from each other. Thus, the product designer can select a strap configuration and longitudinal spacing of straps 24 and form the sheet with the required end portions 27 and connecting central portions 26. Dies that will produce the selected configuration and spacing of the bend-controlling structures are mounted to the appropriate forming equipment, and a run of relatively low volume of sheets is made, with a first bending strap and bend-controlling structure configuration. A second run can be then conducted using a different or varied longitudinal spacing and/or end portion configuration so that a plurality of varied designs can be formed into sheet material in a plurality of low production runs. The next step would be to bend or fold the sheets into structures for the varied designs in quantities sufficient to enable testing of the bent structures for the desired performance criteria, such as loading, fatigue resistance, accuracy of the bend locations, folding forces and other criteria for the structure. Once tested, a selection can be made as between the designs so as to which bending strap configuration and spacing best meets the criteria for the fully formed three-dimensional structure. Having selected the best configuration, production runs of sheet material with the bend-controlling structures from the selected design can be made. The result will be the ability to economically design and reconfigure the structure in low volume runs which makes the process suitable for flexible (rapid) manufacturing and/or prototyping.

One of the important aspects of the present metal bending process is that it also reduces the cost of proceeding to high production, hard tooling runs. The bend-controlling structure produced in the relatively low production runs are extremely precise and accurate in positioning the bends on the sheet. It is a common problem when press brakes are used to prototype designs that once the desired low production press brake bent product has been selected that considerable testing and design adjustment is required when the selected design is to be implemented in hard tooling for high production runs. Bend-controlling structures 22 formed by the stamping and punching processes above described will convert to hard tooling with much less design adjustment because of the bend location accuracy which can be achieved.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

The invention claimed is:

1. A process of forming bend-controlling structures in a sheet of material, the structures being positioned along a desired bend line on alternating sides of the bend line and in longitudinally displaced relation with each structure having a central portion extending substantially parallel to the bend line and end portions diverging away from opposite ends of the central portion to define bending straps between longitudinally adjacent end portions, the process comprising the steps of:

forming the bending straps between the longitudinally adjacent structures at desired locations relative to the bend line by forming the end portions of the structures in the sheet of material to define the bending straps; and by a separate forming step, forming the central portions which connect the end portions to complete the structures.

2. The process as defined in claim 1 wherein, the step of forming the central portions is performed after the step of forming the bending straps.

3. The process as defined in claim 1 wherein, the step of forming the bending straps is accomplished by forming a first pair of laterally spaced apart end portions into the sheet of material on opposite sides of the bend line using an end portion forming die, rotating the end portion forming die by an amount substantially equal to an included angle of the diverging end portions, moving one of the end portion forming die and the sheet of material to a moved position at which the end portion forming die is located at the desired spaced distance from the first pair of end portions, and forming a second pair of laterally spaced apart end portions at the moved position.

4. The process as defined in claim 3 wherein, the end portions are arcuate and diverge away from the bend line by an included angle of about 90 degrees, and the rotating step is accomplished by rotating the end portion forming die by about 90 degrees.

5. The process as defined in claim 3 wherein, the end portions are arcuate and diverge away from the bend line by an included angle of about 60 degrees, and the rotating step is accomplished by rotating the end portion forming die by about 60 degrees.

6. The process as defined in claim 3 wherein, the step of forming the central portions is accomplished using a central portion forming die to connect one of the first pair of end portions to one of the second pair of end portions on the same side of the bend line.

7. The process as defined in claim 6 wherein, the step of forming the central portions is accomplished by forming the central portions by using a central portion forming die having a length less than the length of the central portion to be formed, and the steps of forming a segment of the length of the central portion, moving one of the sheet of material and the central portion forming die, and forming another segment of the length of the central portion, and repeating the step of forming a segment until the full length of the central portion is formed.

8. The process as defined in claim 7 wherein, the steps of forming a segment are accomplished on a turret punch using a rapid stroke made while moving the sheet of material.

9. The process as defined in claim 6 wherein, the step of forming the end portions and the step of forming the central portions are accomplished using an end portion forming die and a central portion forming die adapted to produce a slit penetrating completely through the thickness dimension of the sheet of material.

10. The process as defined in claim 9 wherein, the end portion forming die and the central portion forming die are turret punch dies.

11. The process as defined in claim 1, and the steps of:

varying one of the configuration and the distance between the bending straps to produce a plurality of varied product designs;

conducting a low volume runs of sheets of material using the varied designs;

forming bent structures for varied designs from the low volume runs; and selecting a bending strap configuration and spacing based upon the bent structures.

12. A process of forming bend-controlling structures in a sheet of material, the structures each having a central portion extending substantially parallel to a desired bend line and having end portions diverging away from opposite ends of the central portion, comprising the steps of:

forming a first diverging end portion in the sheet of material at a desired location along the bend line using an end portion forming die;

forming a second end portion in the sheet of material at a predetermined location spaced along the bend line from the first end portion using an end portion forming die; and separately forming a central portion connecting the spaced apart first and second end portions after or before the forming of at least one of the end portions.

13. The process as defined in claim 12 wherein, the step of forming a central portion occurs using a central portion forming die after the steps of forming the first end portion and the second end portion.

14. The process as defined in claim 13 wherein, the step of forming the central portion is accomplished using a plurality of forming steps with a central portion forming die having a length less than the length of the central portion being formed.

15. The process as defined in claim 12 wherein, the step of forming a second end portion is accomplished by forming a second end portion having a shape which is substantially a mirror image of the first end portion.

16. The process as defined in claim 15 wherein, the second end portion is formed by rotating the end portion forming dies by an amount equal to an included angle of the diverging first end portion.

17. The process as defined in claim 12 wherein, a plurality of bending structures are formed on alternating sides of the bend line in longitudinally staggered relation with longitudinally adjacent structures along the bend line defining bending straps therebetween having center lines extending obliquely across the bend line; and wherein, the step of forming a first end portion is repeated at spaced apart locations along one side of the bend line a plurality of times, and is repeated a plurality of times along the other side of the bend line;

the step of forming a second end portion is repeated at spaced apart locations along one side of the bend line, and is repeated a plurality of times along the other side of the bend line to define with the first end portions a plurality of bending straps having a desired configuration; and the step of forming a central portion is repeated a plurality of times on both sides of the bend line to complete formation of the structures.

18. The process as defined in claim 17 wherein, the step of forming the second end portions on one side of the bend line is accomplished by rotating the end portion forming die by about the included angle of the diverging end portions; and the step of forming the second end portions on the other side of the bend line is accomplished by rotating the same end portion forming die by about 180 degrees for and then rotating the same die by about the included angle from the 180 degree orientation.

19. The process as defined in claim 12 wherein, the steps of forming the first end portion and the second end portion are accomplished using an end portion forming die having art arcuate shape.

20. The process as defined in claim 12 wherein, the forming steps form a bend-controlling structure which is a slit.

21. The process as defined in claim 12 wherein, the forming steps displace an area of the sheet of material to form the bend-controlling structure.

22. The process as defined in claim 12 wherein, the end portion forming die is adapted to form two laterally spaced apart end portions of bend-controlling structures on opposite sides of the bend line to define a bending strap of a desired configuration, and the step of forming the first end portion simultaneously forms a first end portion on another bend-controlling structure on an opposite side of the bend line.

23. A process of forming bend-controlling structures in a sheet of material, the structures being positioned along a desired bend line on alternating sides of the bend line and in longitudinally displaced relation with each structure having a central portion extending substantially parallel to the bend line and end portions diverging away from opposite ends of the central portion to define bending straps between longitudinally adjacent end portions, the process comprising the steps of:

forming the structures by using a right-end portion forming die and a separate left-end portion forming die to form completed bend-controlling structures, the right-end portion forming die and the left-end forming die each including an end portion and a segment of a central portion of the structure, the forming step being accomplished by positioning the dies for location of the segments of the central portion of each of the dies in alignment with each other, one of the end portion forming dies being positioned after or before the other of the end portion forming dies.

24. The process as defined in claim 23 wherein, the step of forming the right-hand end portion is accomplished by spacing the segments of the central portions of each of the dies from each other along the bend line; and the step of connecting the spaced segments of the central portions of each of the dies by using a central portion segment forming die.

25. The process as defined in claim 23 wherein, the forming step is accomplished by using one of the dies to form a part of each structure at spaced apart distances along the bend line on both sides of the bend line, and thereafter the other of the dies is used to form a remainder of each structure along both sides of the bend line.

26. The process as defined in claim 25 wherein, the forming step is accomplished by overlapping the segments of the central portion of each of the dies.

27. The process as defined in claim 25 wherein, the forming step is accomplished by using the dies in a turret punch apparatus.

28. A set of dies for forming bend-controlling structures in a sheet of material, the bend controlling structures including central portions to be positioned in substantially parallel relation along a desired bend line and end portions diverging away from the bend line at opposite ends of the central portion, the set of dies comprising:

at least one end portion forming die set having mating die surfaces formed to produce at least one end portion of a desired shape; and a central portion forming die set having mating die surfaces formed to produce at least a segment of a central portion of the bend-controlling structure using a single stroke of the central portion forming die set, so that the central portion forming die set produces the at least a segment of the central portion after or before the at least one end portion forming die set produces the at least one end portion of the desired shape.

29. The set of dies defined in claim 28 wherein, the end portion forming die set is formed to produce two bend-controlling end portions positioned at desired laterally spaced apart locations on opposite sides of the bend line.

30. The set of dies as defined in claim 28 wherein, the central portion forming die set has mating die surfaces producing a substantially linear central portion segment with one end of the die being near vertical to the sheet of material and the opposite end of the die being sloped to gradually enter the sheet of material.

31. The set of dies as defined in claim 28, and a plurality of end portion forming dies having differing end portion shapes suitable for connecting together by a linear central portion forming die set; and the central portion forming die set has mating surfaces producing a linear central portion segment.

32. The set of dies defined in claim 31 wherein, the end portion forming die sets each an formed to produce two bend-controlling end portions at laterally spaced apart locations on opposite sides of the bend line.

33. A set of dies for forming bend-controlling structures in a sheet of material, the bend controlling structures including central portions to be positioned in substantially parallel relation along a desired bend line and end portions diverging away from the bend line at opposite ends of the central portion, the set of dies comprising:

a right-end portion forming die set having mating die surfaces formed to produce a right-end portion of a desired shape and a segment of the central portion of the structures; and a left-end portion forming die set having mating die surfaces formed to produce a left-end portion of a desired shape and a segment of the central portion of the structure, so that the left-end portion forming die set produces the left-end portion of the desired shape after or before the right-end portion forming die set produces the right-end portion of the desired shape.

34. The set of dies as defined in claim 33 wherein, the right-end potion die set and the left-end portion die set are formed to produce end portions which are mirror images of each other.

35. A process of forming at least one bend-controlling structure in a sheet of material, the structure having a central portion extending substantially parallel to a desired bend line and having end portions diverging away from opposite ends of the central portion, comprising the steps of:

simultaneously forming a pair of diverging end portions in the sheet of material at a desired location along the bend line using one of a predetermined forming die, punch and stamp; and forming a central portion connecting the pair of diverging end portions after or before the step of forming a pair of diverging end portions.

36. The process of claim 35 wherein said process further includes:

forming an additional pre-selected number of bend-controlling structures along said bend line in said sheet.

37. The process as defined in claim 36, and the steps of:

varying one of the configuration and the distance between the bending-controlling structures to produce a plurality of varied prototype designs;

conducting prototype runs of sheets of material using the varied prototype designs;

forming bent structures for varied prototype designs from the prototype runs;

selecting a prototype bend-controlling structure configuration and spacing based upon the bent structures;

fabricating production dies using the selected prototype bend-controlling structure configuration and spacing; and conducting production runs of the sheets of material with bend-controlling structures using production dies, stamps and punches.

* * * * *

UNITED STATES PATENT AND TRADEMARK OFFICE

CERTIFICATE OF CORRECTION

PATENT NO. : 7,222,511 B2
APPLICATION NO. : 10/985373
DATED : May 29, 2007
INVENTOR(S) : Max W. Durney et al.

It is certified that error appears in the above-identified patent and that said Letters Patent is hereby corrected as shown below:

In claim 34, col. 25, line 13, change “the right-end potion dle set” to --the right-end portion die set--.

Signed and Sealed this

Tenth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 7,222,511 B2
APPLICATION NO. : 10/985373
DATED : May 29, 2007
INVENTOR(S) : Max W. Durney et al.

It is certified that error appears in the above-identified patent and that said Letters Patent is hereby corrected as shown below:

ON THE TITLE PAGE – Item (63) Related U.S. Application Data

Delete the paragraph and insert the following:

--Continuation-in-part of application No. 10/795,077, filed on Mar. 3, 2004, now Pat. No. 7,152,450, which is a continuation-in-part of application No. 10/672,766 filed on Sep. 26, 2003, now Pat. No. 7,152,449, which is a continuation-in-part of application No. 10/256,870 filed on Sep. 26, 2002, now Pat. No. 6,877,349, which is a continuation-in-part of application No. 09/640,267, filed on Aug. 17, 2000, now Pat. No. 6,481,259.--

IN THE SPECIFICATION

Col. 1, beginning at line 8, delete the paragraph and insert the following:

--This application is a continuation-in-part application based upon a patent application Ser. No. 10/795,077, filed Mar. 3, 2004, now U.S. Pat. No. 7,152,450, and entitled Sheet Material with Bend Controlling Displacements and Method for Forming the Same, which is a continuation-in-part application based upon patent application Ser. No. 10/672,766, filed Sep. 26, 2003, now U.S. Pat. No. 7,152,449, and entitled Techniques for Designing and Manufacturing Precision-Folded, High Strength, Fatigue-Resistant Structures and Sheet Therefor, which is a continuation-in-part application based upon patent application Ser. No. 10/256,870, filed Sep. 26, 2002, now U.S. Pat. No. 6,877,349 and entitled Method for Precision Bending of Sheet Materials, Slit Sheet and Fabrication Process, which was a continuation-in-part application based upon a patent application Ser. No. 09/640,267, filed Aug. 17, 2000, and entitled Method

UNITED STATES PATENT AND TRADEMARK OFFICE

CERTIFICATE OF CORRECTION

PATENT NO. : 7,222,511 B2
APPLICATION NO. : 10/985373
DATED : May 29, 2007
INVENTOR(S) : Max W. Durney et al.

It is certified that error appears in the above-identified patent and that said Letters Patent is hereby corrected as shown below:

for Precision Bending of a Sheet of Material and Slit Sheet Therefor, now U.S. Pat. No. 6,481,259 B1.--

Signed and Sealed this

Eighteenth Day of August, 2009

David J. Kappos

David J. Kappos
*Director of the United States Patent and Trademark Office*